US008665052B2

(12) United States Patent
Lai

(10) Patent No.: US 8,665,052 B2
(45) Date of Patent: Mar. 4, 2014

(54) TRANSFORMER-BASED CIRCUIT WITH COMPACT AND/OR SYMMETRICAL LAYOUT DESIGN

(75) Inventor: Jie-Wei Lai, Taipei (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 691 days.

(21) Appl. No.: 12/540,358

(22) Filed: Aug. 12, 2009

(65) Prior Publication Data

US 2011/0037555 A1 Feb. 17, 2011

(51) Int. Cl.
*H01F 5/00* (2006.01)
*H01F 27/28* (2006.01)

(52) U.S. Cl.
USPC ..... 336/200; 336/182; 336/183; 336/232

(58) Field of Classification Search
USPC ..... 336/182, 183, 200, 232
See application file for complete search history.

(56) References Cited

U.S. PATENT DOCUMENTS

| | | | | |
|---|---|---|---|---|
| 6,476,704 | B2 * | 11/2002 | Goff | 336/200 |
| 7,129,784 | B2 | 10/2006 | Bhatti | |
| 2001/0033204 | A1 * | 10/2001 | Simburger et al. | 333/24 R |
| 2003/0001709 | A1 * | 1/2003 | Visser | 336/200 |
| 2006/0132274 | A1 * | 6/2006 | Lee et al. | 336/200 |
| 2008/0164941 | A1 * | 7/2008 | Lee et al. | 330/124 R |
| 2008/0174396 | A1 * | 7/2008 | Choi et al. | 336/182 |
| 2008/0290976 | A1 | 11/2008 | Feldtkeller | |
| 2009/0174515 | A1 * | 7/2009 | Lee et al. | 336/182 |
| 2010/0164667 | A1 * | 7/2010 | Ho-Hsiang | 336/200 |

FOREIGN PATENT DOCUMENTS

| | | | |
|---|---|---|---|
| CN | 1522450 | A | 8/2004 |
| CN | 101242159 | A | 8/2008 |
| EP | 1855297 | A1 * | 11/2007 |

OTHER PUBLICATIONS

Haldi, "A 5.8 GHz Linear Power Amplifier in a Standard 90nm CMOS Process using a 1V Power Supply," pp. 431-434, 2007 IEEE Radio Frequency Integrated Circuits Symposium, 2007.

An, "A Monolithic Voltage-Boosting Parallel-Primary Transformer Structures for Fully Integrated CMOS Power Amplifier Design," pp. 419-422, 2007 IEEE Radio Frequency Integrated Circuits Symposium, 2007.

* cited by examiner

*Primary Examiner* — Tsz Chan
(74) *Attorney, Agent, or Firm* — Winston Hsu; Scott Margo

(57) ABSTRACT

A transformer-based circuit has at least a first port and a plurality of second ports. The transformer-based circuit includes a first winding conductor and a plurality of second winding conductors. The first winding conductor is electrically connected to the first port, and has a plurality of sectors connected in series to thereby form a plurality of loops, where the loops are arranged in a concentric-like fashion. The second winding conductors are magnetically coupled to the first winding conductor; besides, the second winding conductors are electrically connected to the second ports, respectively. Overall layout patterns of the second winding conductors are identical to each other. The first winding conductor acts as one of a primary winding conductor and a secondary winding conductor, and each of the second winding conductors acts as the other of the primary winding conductor and the secondary winding conductor.

28 Claims, 25 Drawing Sheets

TRANSFORMER-BASED CIRCUIT WITH COMPACT AND/OR SYMMETRICAL LAYOUT DESIGN

BACKGROUND

The present invention relates to dealing with the signal power, and more particularly, to a transformer-based circuit which realizes a transformer power combiner/splitter with compactness and/or symmetry.

Power combining technique is commonly employed in a wireless communication system to combine a plurality of input signals into an output signal; besides, power splitting technique is also commonly employed in a wireless communication system to split an input signal into a plurality of output signals. One possible power combining implementation is to use a transformer power combiner, and one possible power splitting implementation is to use a transformer power splitter.

However, how to implement a compact, low-loss, and/or low-cost transformer power combiner/splitter is a big challenge to the designers in this technical field.

SUMMARY OF THE INVENTION

In accordance with embodiments of the present invention, exemplary circuits of the transformer power combiner/splitter are proposed.

According to one aspect of the present invention, an exemplary transformer-based circuit is provided. The exemplary transformer-based circuit has at least a first port and a plurality of second ports. The transformer-based circuit includes a first winding conductor and a plurality of second winding conductors. The first winding conductor is electrically connected to the first port, and has a plurality of sectors connected in series to thereby form a plurality of loops, where the loops are arranged in a concentric-like fashion. The second winding conductors are magnetically coupled to the first winding conductor; besides, the second winding conductors are electrically connected to the second ports, respectively. Overall layout patterns of the second winding conductors are identical to each other. The first winding conductor acts as one of a primary winding conductor and a secondary winding conductor, and each of the second winding conductors acts as the other of the primary winding conductor and the secondary winding conductor.

According to another aspect of the present invention, an exemplary transformer-based circuit is provided. The transformer-based circuit has a first port and a plurality of second ports. The transformer-based circuit includes a first winding conductor and a plurality of second winding conductors. The first winding conductor is electrically connected to the first port, and an overall layout pattern of the first winding conductor is symmetrical. Besides, the first winding conductor has a plurality of sectors connected in series to thereby form a plurality of loops, where the loops are arranged in a concentric-like fashion. The second winding conductors are magnetically coupled to the first winding conductor; besides, the second winding conductors are electrically connected to the second ports, respectively. An overall layout pattern of each of the second winding conductors is symmetrical. The first winding conductor acts as one of a primary winding conductor and a secondary winding conductor, and each of the second winding conductors acts as the other of the primary winding conductor and the secondary winding conductor.

According to yet another aspect of the present invention, an exemplary transformer-based circuit is provided. The transformer-based circuit has a first port and a plurality of second ports. The transformer-based circuit includes a first winding conductor and a plurality of second winding conductors. The first winding conductor is electrically connected to the first port, and has a plurality of sectors connected in series to thereby form a plurality of loops, where the loops are arranged in a concentric-like fashion. The second winding conductors are magnetically coupled to the first winding conductor, where the second winding conductors are electrically connected to the second ports, respectively, and each of the loops of the first winding conductor is magnetically coupled by all of the second winding conductors such that the second winding conductors and the loops of the first winding conductor are fully twisted together. The first winding conductor acts as one of a primary winding conductor and a secondary winding conductor, and each of the second winding conductors acts as the other of the primary winding conductor and the secondary winding conductor.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " The terms "couple" and "couples" are intended to mean either an indirect or a direct electrical connection. Thus, if a first device couples to a second device, that connection may be through a direct electrical connection, or through an indirect electrical connection via other devices and connections.

Figure 1:
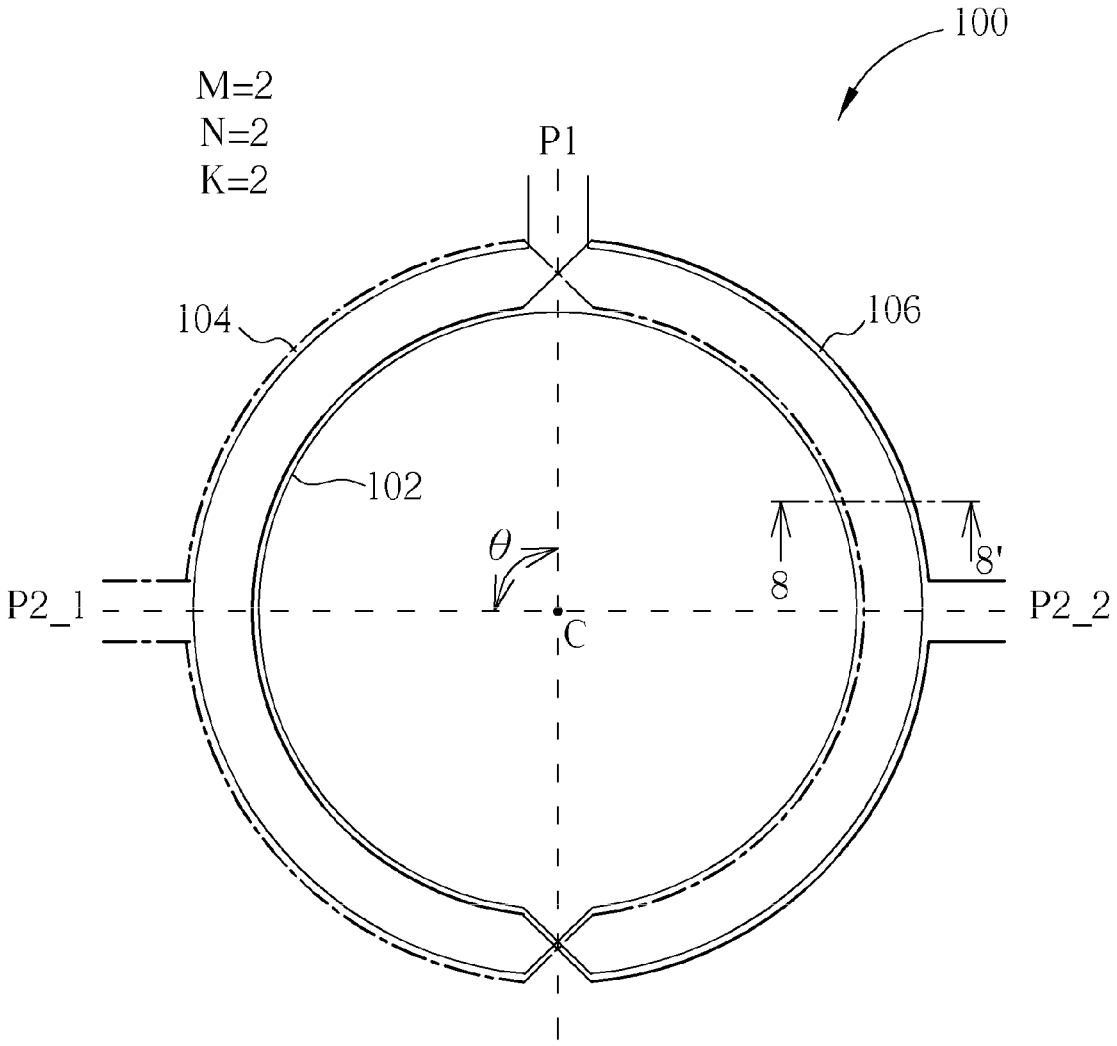
FIG. 1 is a diagram illustrating an exemplary transformer-based circuit according to the present invention.
Figure 2:
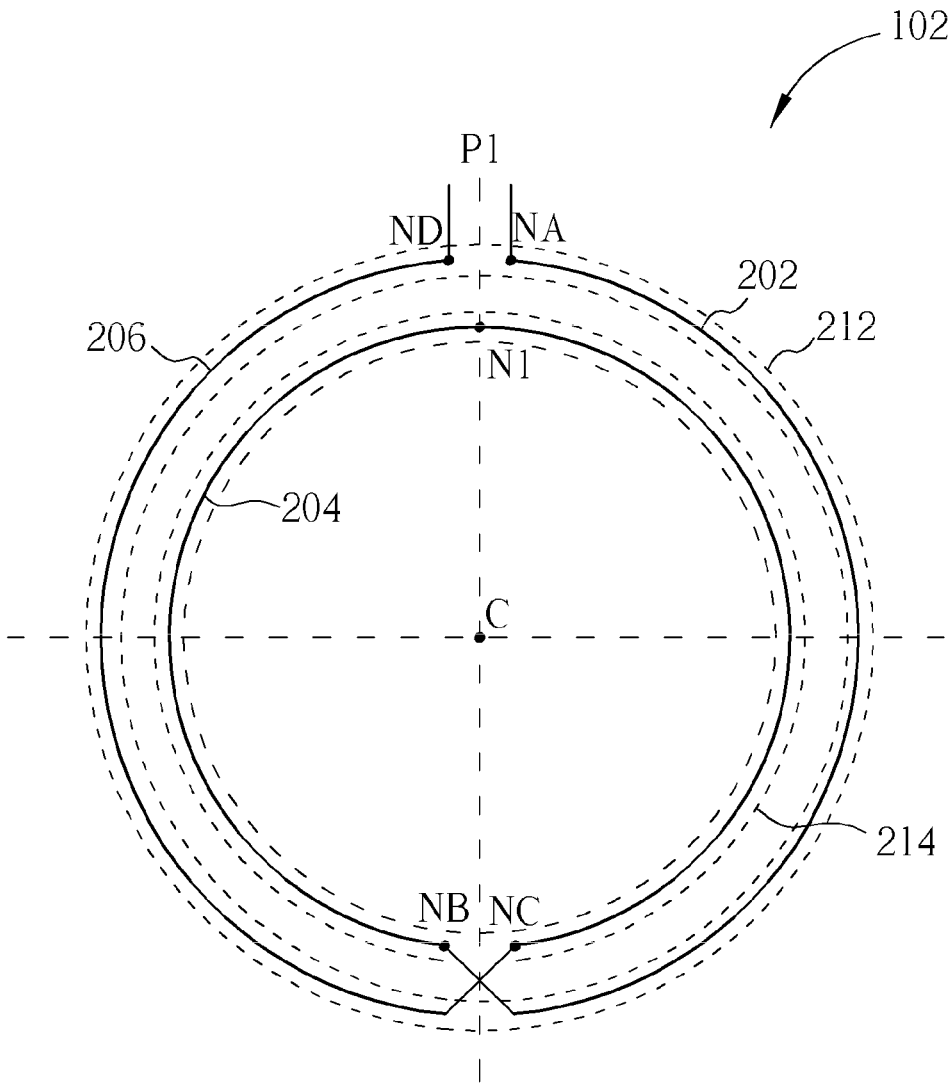
FIG. 2 is a diagram illustrating a layout pattern of a first winding conductor shown in FIG. 1.
Figure 3:
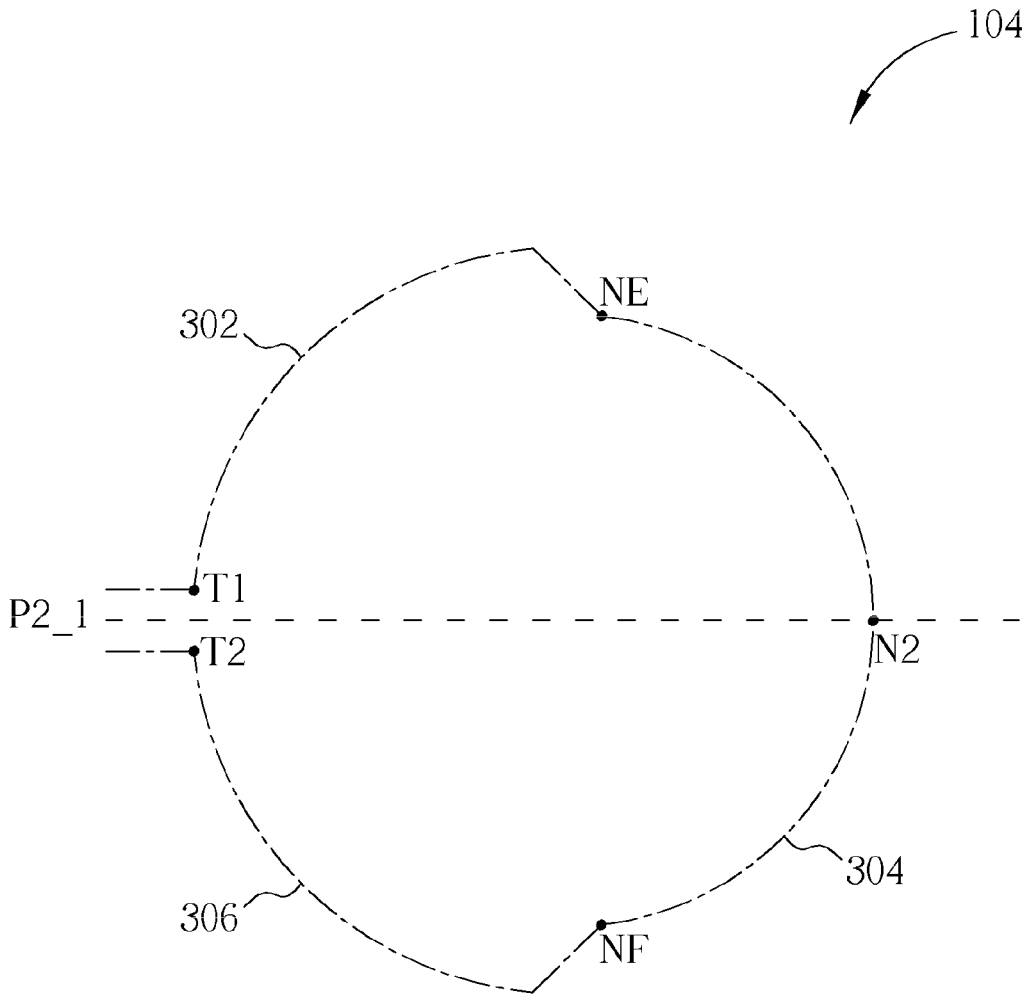
FIG. 3 is a diagram illustrating a layout pattern of one second winding conductor shown in FIG. 1.
Figure 4:
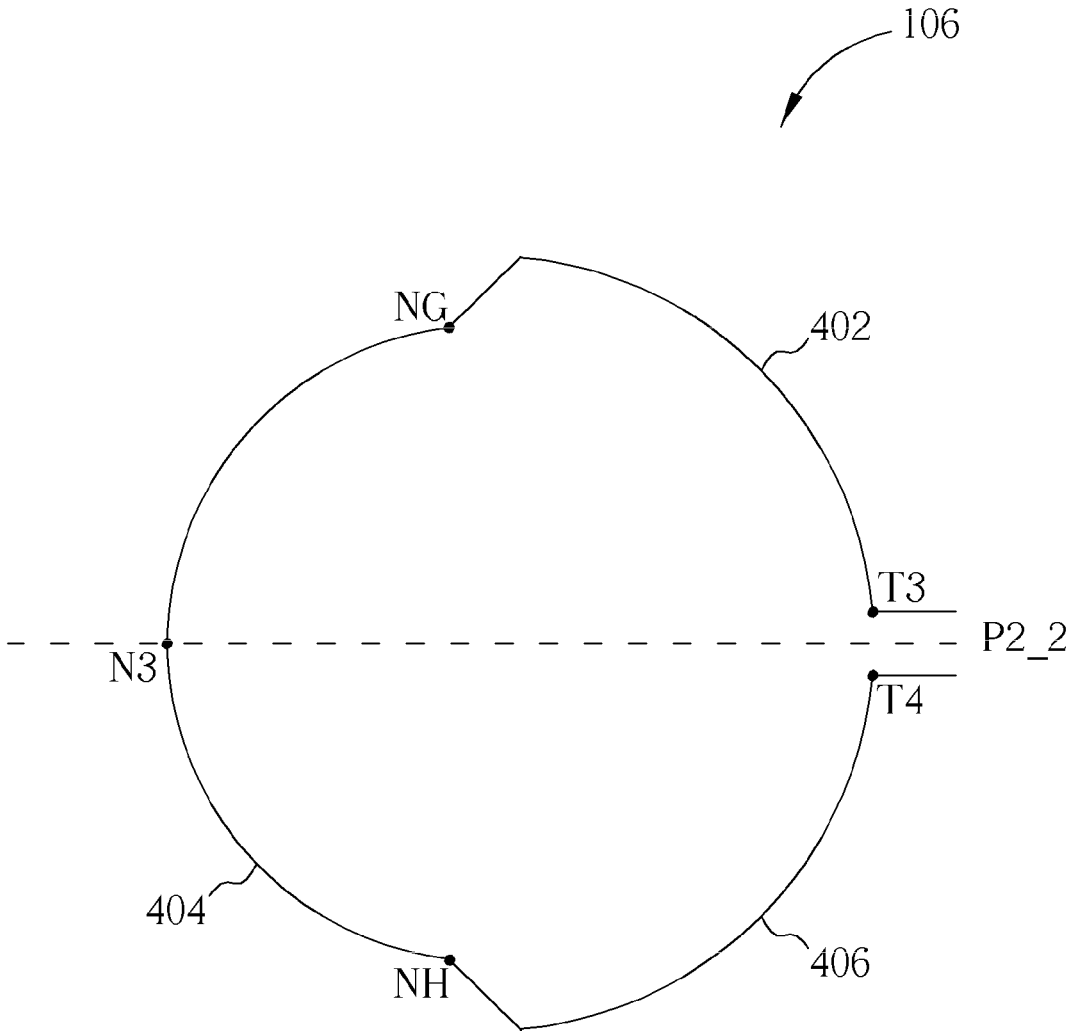
FIG. 4 is a diagram illustrating a layout design of the other second winding conductor shown in FIG. 1.

FIG. 1 is a diagram illustrating one exemplary embodiment of a transformer-based circuit according to the present invention. The exemplary transformer-based circuit 100 has a first port P1 and a plurality of second ports P2_1, P2_2, and includes a first winding conductor 102 and a plurality of second winding conductors 104, 106. The first winding conductor 102 is electrically connected to the first port P1. The second winding conductors 104, 106 are magnetically coupled to the first winding conductor 102, and the second winding conductors 104, 106 are electrically connected to the second ports P2_1, P2_2, respectively. For clarity, the layout patterns of the first winding conductor 102 and the second winding conductors 104, 106 are shown in FIG. 2, FIG. 3, and FIG. 4, respectively. Please note that the total number of the winding conductors and shapes (layout patterns) of the winding conductors are for illustrative purposes only.

Figure 5:
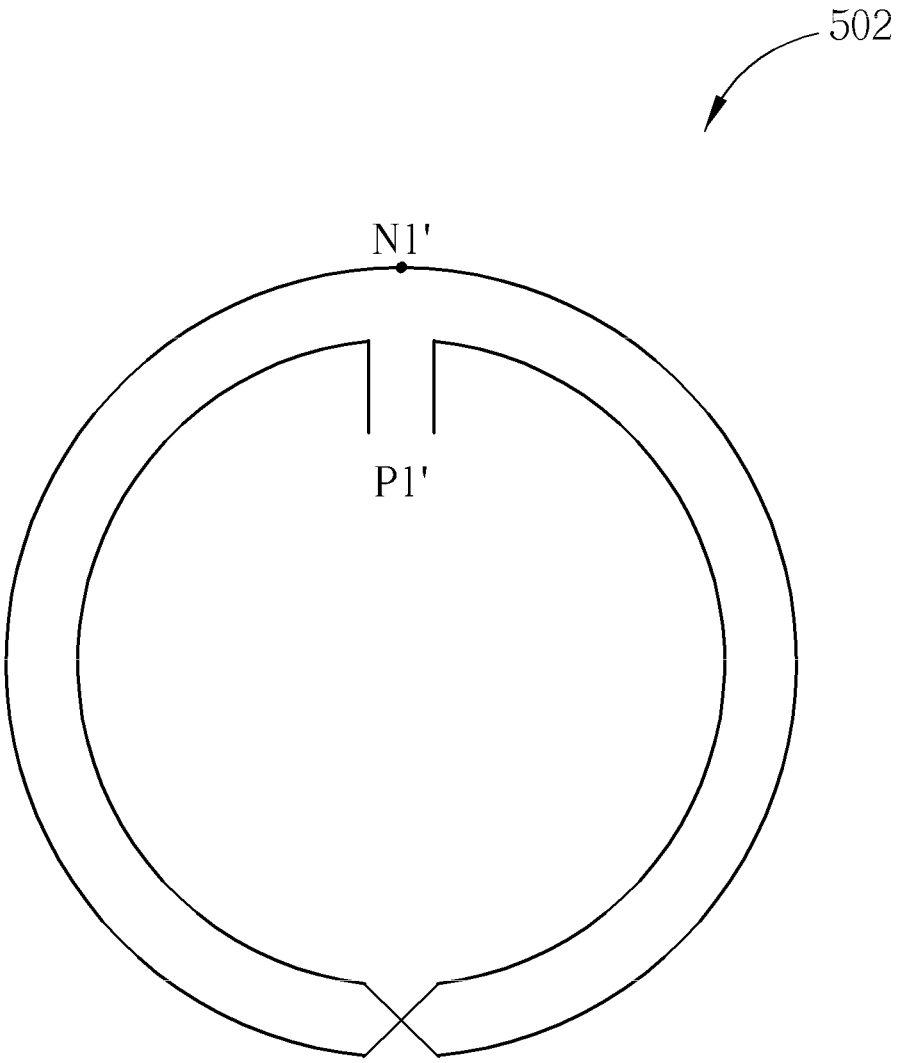
FIG. 5 is a diagram illustrating an alternative layout design of the first winding conductor shown in FIG. 1.

In a case where the transformer-based circuit 100 is a transformer power splitter, the first winding conductor 102 is configured to act as a primary winding conductor, and each of the second winding conductors 104, 106 is configured to act as a secondary winding conductor. Therefore, the first port P1 serves as an input port of a 1-to-2 transformer power splitter to receive an input signal, and the second ports P2_1 and P2_2 serve as output ports of the transformer power splitter to output two output signals derived from the input signal. In addition, node N1 marked in the exemplary layout design in FIG. 2 is to serve as a center-tap node of the primary winding conductor. By way of example, but not limitation, the center-tap node N1 can be used to act as a voltage feeding point. For instance, a bias voltage can be supplied to the center-tap node N1. Furthermore, the first winding conductor 102, as shown in FIG. 2, has a plurality of sectors 202, 204, 206 connected in series to thereby form a plurality of loops 212, 214, where the loops 212, 214 are arranged in a concentric-like fashion. As can be seen from FIG. 2, the sector 202 has two ends terminated at nodes NA and NB, respectively; the sector 204 has two ends terminated at nodes NB and NC, respectively; and the sector 206 has two ends terminated at nodes NC and ND, respectively. However, it should be noted that the illustrated segmentation applied to the first winding conductor 102 merely serves one possible implementation, and should not be treated as a limitation to the scope of the present invention. By way of example, but not limitation, the loops 212, 214 in this exemplary embodiment are concentric circles with the same common center C. Please note that the loops formed by the first winding conductor 102 may have other loop shape, and/or the loops arranged in the concentric-like fashion may not have the same common center. These slight modifications all fall within the scope of the present invention. As shown in FIG. 2, the first port P1 is connected to an outer-most loop (i.e., 212), and the center-tap node N1 is positioned at the inner-most loop (i.e., 214). However, it should be noted that the locations of the first port P1 and the center-tap node N1 can be swapped according to requirements of an actual application. That is, in an alternative design as shown in FIG. 5, the first port P1' of the exemplary first winding conductor 502 is connected to an inner-most loop, and the node N1' of the exemplary first winding conductor 502 is positioned at the outer-most loop.

As shown in FIG. 3 and FIG. 4, each of the second winding conductors 104 and 106 also has a plurality of sectors 302, 304, 306 and 402, 404, 406 connected in series, where the sector 302 has two ends terminated at nodes T1 and NE, respectively; the sector 304 has two ends terminated at nodes NE and NF, respectively; the sector 306 has two ends terminated at nodes NF and T2, respectively; the sector 402 has two ends terminated at nodes T3 and NG, respectively; the sector 404 has two ends terminated at nodes NG and NH, respectively; and the sector 406 has two ends terminated at nodes NH and T4, respectively. It should be noted that the illustrated segmentation applied to the second winding conductors 104 and 106 merely serves one possible implementation, and should not be treated as a limitation to the scope of the present invention. Specifically, the sectors 302, 304, 306 of the second winding conductor 104 include a leading sector (e.g., 302/306) starting from a first terminal (e.g., T1/T2) of the corresponding second port P2_1 and a last sector (e.g., 306/302) ending up at a second terminal (T2/T1) of the corresponding second port P2_1 in a clockwise/counterclockwise direction. Similarly, the sectors 402, 404, 406 of the second winding conductor 106 include a leading sector (e.g., 402/406) starting from a first terminal (e.g., T3/T4) of the corresponding second port P2_2 and a last sector (e.g., 406/402) ending up at a second terminal (T4/T3) of the corresponding second port P2_2 in a counterclockwise/clockwise direction.

Figure 6:
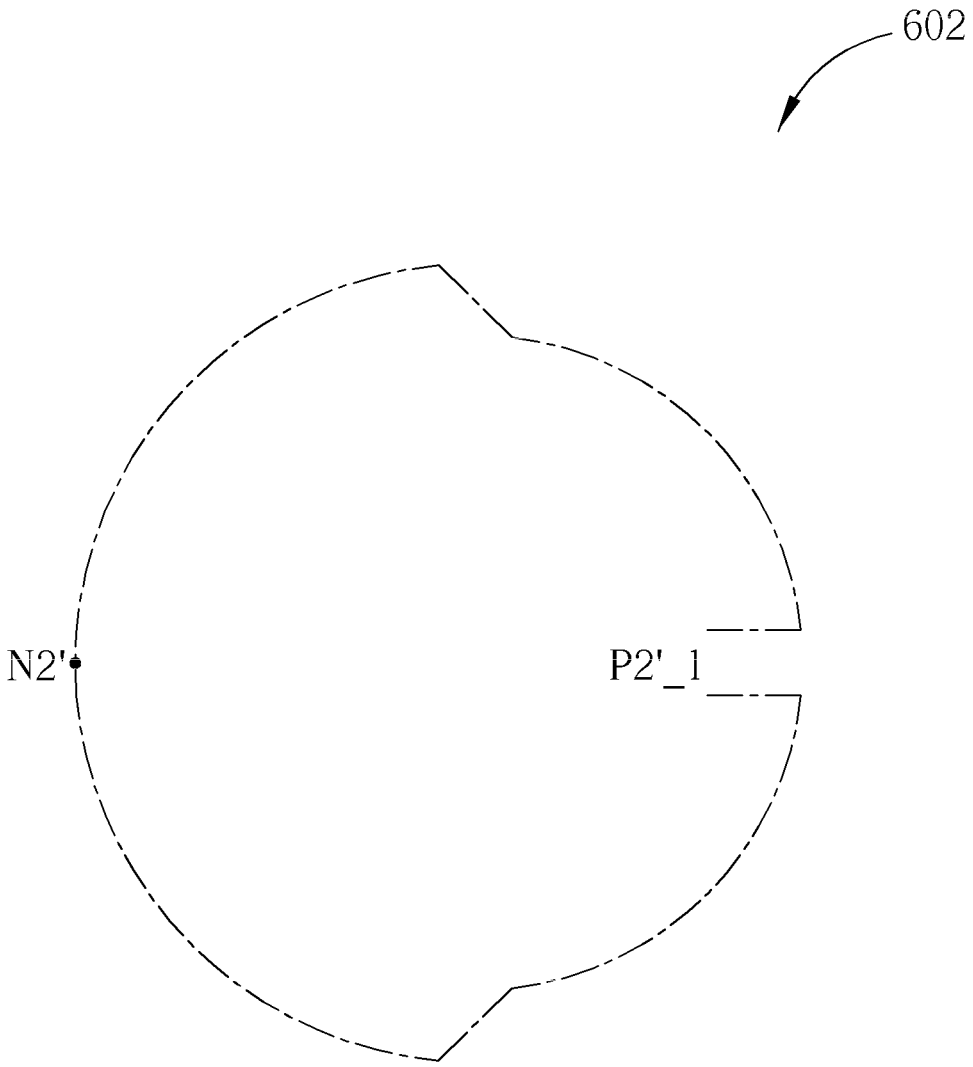
FIG. 6 is a diagram illustrating an alternative layout pattern of one second winding conductor shown in FIG. 1.
Figure 7:
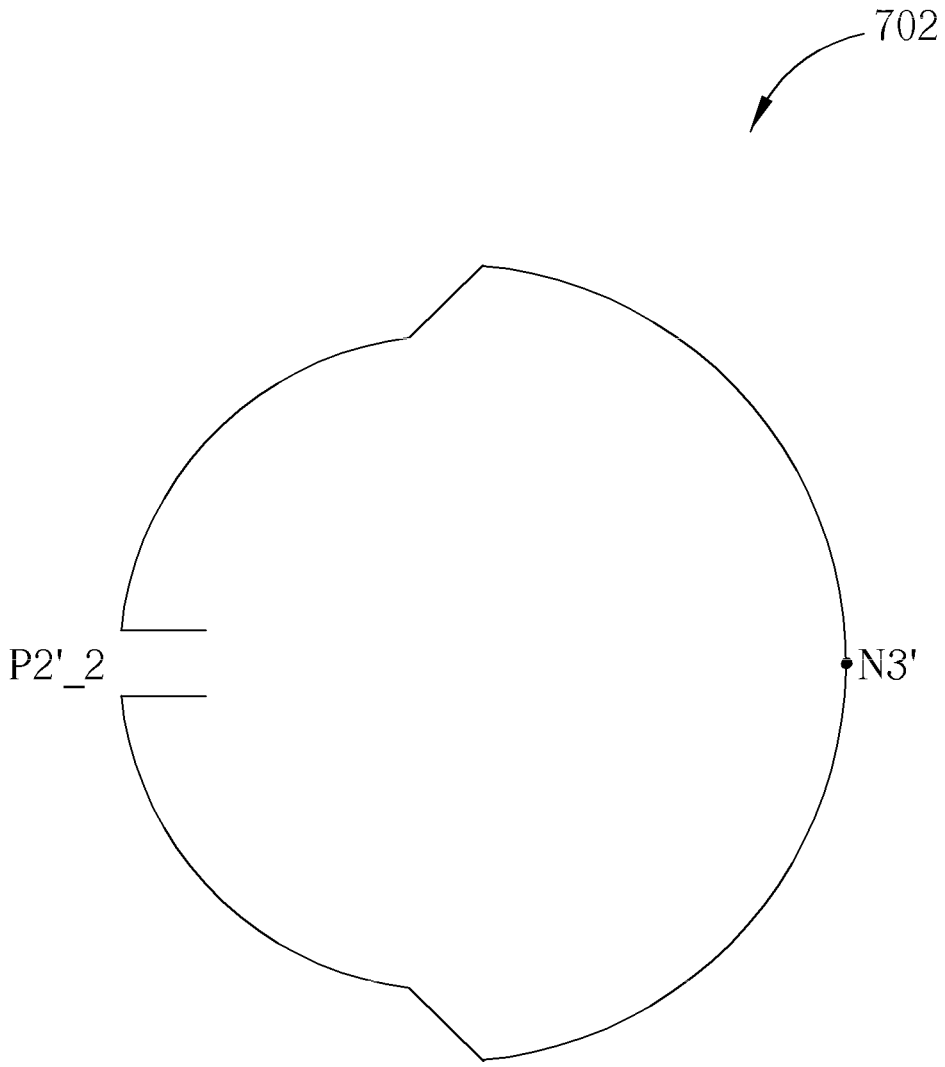
FIG. 7 is a diagram illustrating an alternative layout design of the other second winding conductor shown in FIG. 1.

Please refer to FIG. 1 in conjunction with FIG. 2-FIG. 4. The leading sector and the last sector (e.g., 302 and 306, or 402 and 406) are both magnetically coupled to the outer-most loop 212. However, it should be noted that the locations of the second port P2_1/P2_2 and the node N2/N3 can also be swapped according to requirements of an actual application. That is, in an alternative design as shown in FIG. 6, the second port P2'_1 of the exemplary second winding conductor 602 will be magnetically coupled to the inner-most loop 214, and the node N2' of the exemplary second winding conductor 602 is positioned at the outer-most loop 212; similarly, in an alternative design as shown in FIG. 7, the second port P2'_2 of the exemplary second winding conductor 702 will be magnetically coupled to the inner-most loop 214, and the node N3' of the exemplary second winding conductor 702 is positioned at the outer-most loop 212. These also obey the spirit of the present invention. If layout symmetry is taken into consideration, the second winding conductor 106/104 should be replaced by the second winding conductor 702/602 as long as the other second winding conductor 104/106 is replaced by the second winding conductor 602/702.

In another case where the transformer-based circuit 100 is a transformer power combiner, the first winding conductor 102 is configured to act as a secondary winding conductor, and each of the second winding conductors 104, 106 is configured to act as a primary winding conductor. Therefore, the second ports P2_1 and P2_2 serve as input ports of a 2-to-1 transformer power combiner to receive two input signals, and the first port P1 serves as an output port of the 2-to-1 transformer power combiner to output an output signal derived from the input signals. In addition, node N2 marked in the layout pattern in FIG. 3 and node N3 marked in the layout pattern in FIG. 4 serve as center-tap nodes of primary winding conductors, respectively. By way of example, but not limitation, each of the center-tap nodes N2 and N3 can be used to act as a voltage feeding point. For instance, a bias voltage is supplied to each of the center-tap nodes N2 and N3. As mentioned above, the first winding conductor 102 has sectors 202, 204, 206 connected in series to thereby form loops 212, 214, and the first port P1 can be connected to either an inner-most loop or an outer-most loop, depending upon actual design requirements. As shown in FIG. 3 and FIG. 4, the second winding conductor 104 has a specific sector (e.g., 304) where a corresponding center-tap node N2 is located, and the second winding conductor 106 has a specific sector (e.g., 404) where a corresponding center-tap node N3 is located. Please refer to FIG. 1 in conjunction with FIG. 2-FIG. 4. The leading sector and the last sector (e.g., 302 and 306, or 402 and 406) are both magnetically coupled to the outer-most loop 212, and the specific sector (e.g., 304 or 404) is magnetically coupled to the inner-most loop 214. Similarly, the locations of the second port P2_1/P2_2 and the node N2/N3 can be swapped according to requirements of an actual application.

Please note that the exemplary transformer-based circuit 100 can be realized using a semiconductor process. Therefore, all of the winding conductors, including the first winding conductor 102 and the second winding conductors 104, 106, are electrically conductive traces routed on metal layers. Besides, in the example, two metal layers are involved in implementing each crossing of winding conductors. In other words, electrically conductive traces have no physical contact at the winding conductor crossing point illustrated in FIG. 1.

As can be seen from the drawings, the first winding conductor 102 has a symmetrical layout around the first port P1, and each of the second winding conductors 104, 106 also has a symmetrical layout around a corresponding second port P2_1, P2_2. More specifically, in this exemplary embodiment, an overall layout pattern of the first winding conductor 102, as clearly shown in FIG. 2, is symmetrical, and an overall layout pattern of each of the second winding conductors 104, 106, as clearly shown in FIG. 3 and FIG. 4, is symmetrical. Besides, as can be seen from FIG. 3 and FIG. 4, overall layout patterns of the second winding conductors 104, 106 are identical to each other. However, using second winding conductors with the same symmetrical layout pattern merely serves as one possible implementation of the exemplary transformer-based circuit, such as a transformer power splitter or a transformer power combiner. Any transformer-based circuit employing second winding conductors with the same layout pattern and/or symmetrical layout patterns obeys the spirit of the present invention.

Figure 8:
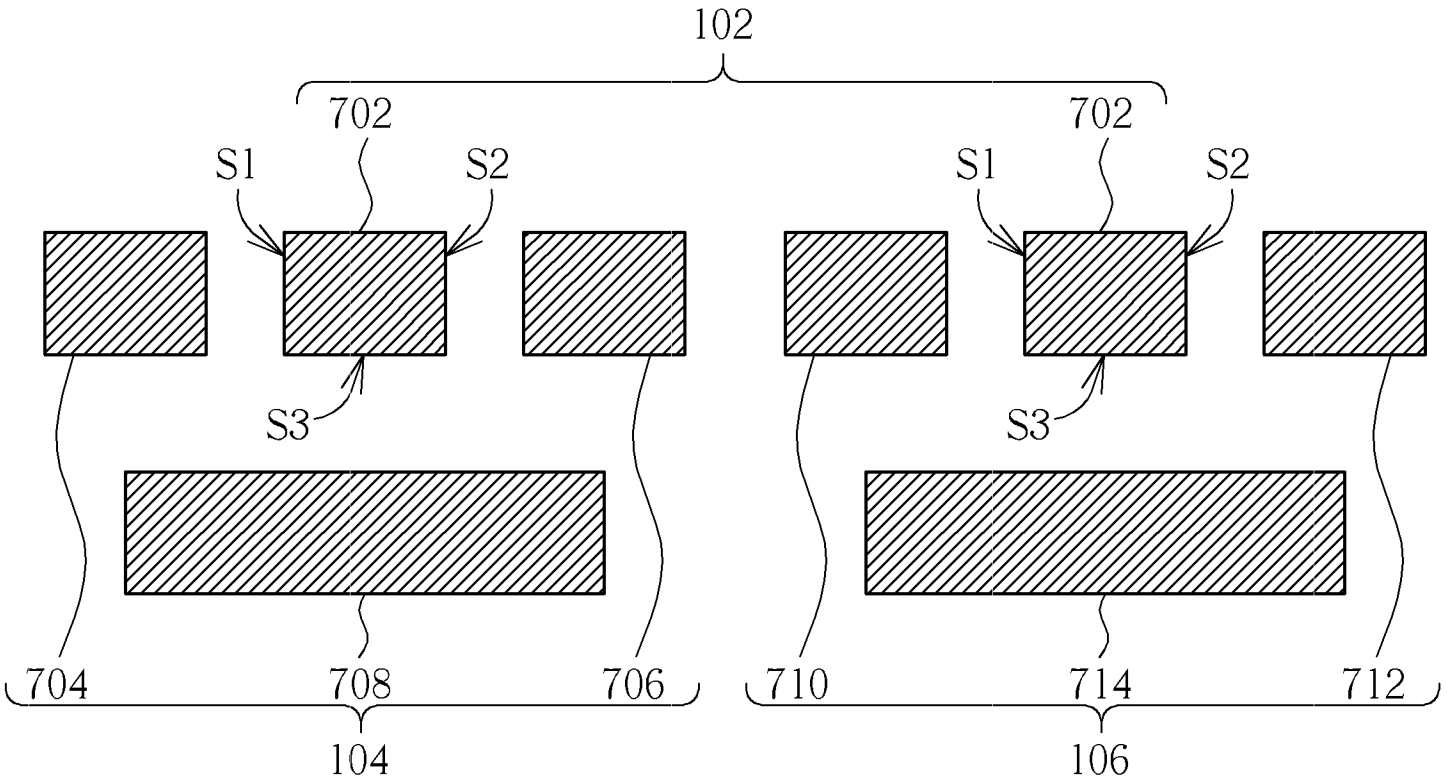
FIG. 8 is a sectional view along the line 8-8' of the transformer-based circuit shown in FIG. 1.

In one implementation, with regard to the transformer-based circuit 100 shown in FIG. 1, the first winding conductor 102 is implemented using a single metal strip 702, and each of the second winding conductors 104, 106 comprises a first metal strip 704, 710, a second metal strip 706, 712, and a third metal strip 708, 714. Please refer to FIG. 8, which is a sectional view along the line 8-8' of the transformer-based circuit 100 shown in FIG. 1. As shown in FIG. 8, the single metal strip 702, the first metal strip 704/710, and the second metal strip 706/712 are coplanar, where the first metal strip 702 and the second metal strip 706/712 are adjacent to a first side S1 and a second side S2 of the single metal strip 702, respectively, and the third metal strip 708/714 is adjacent to a third side S3 of the single metal strip 702. The first metal strip 704, the second metal strip 706 and the third metal strip 708 may be electrically connected by vias; similarly, the first metal strip 710, the second metal strip 712 and the third metal strip 714 may be electrically connected by vias. For example, the first metal strip 704/710 formed on a top metal layer is electrically connected to the third metal strip 708/714 formed on a bottom metal layer by one via penetrating a dielectric layer between the top metal layer and the bottom layer, and the second metal strip 706/712 formed on the top metal layer is electrically connected to the third metal strip 708/714 formed on the bottom metal layer by another via penetrating the dielectric layer. It should be noted that the group of the first metal strip 704, the second metal strip 706 and the third metal strip 708 and the group of the first metal strip 710, the second metal strip 712 and the third metal strip 714 belong to different second winding conductors, say, 104 and 106. The second metal strip 706 therefore should be isolated from the first metal strip 710; that is, the second winding conductors 104 and 106 do not share any metal strip. As mentioned above, two metal layers are involved in implementing each crossing of winding conductors. To reduce the circuit layout complexity of the crossing of winding conductors, the third metal strips 708 and 714 are preferably terminated around the winding conductor crossing structure. In other words, the crossing structures of the winding conductors do not have the third metal strips 708 and 714 implemented therein. In this way, routing metal strips (i.e., electrically conductive traces) from one metal layer to another metal layer is simplified.

Furthermore, in an alternative design, the first metal strip 704/710, the second metal strip 706/712, and the third metal strip 708/714 can be directly arranged to form a slot structure for accommodating the single metal strip 702. In other words, the cross section of each of the second winding conductors 104, 106 would have a U-shape. In this way, the first metal strip 702 and the second metal strip 706/712 are still adjacent to the first side S1 and the second side S2 of the single metal strip 702, respectively, and the third metal strip 708/714 is still adjacent to the third side S3 of the single metal strip 702.

As the coupling area between the first winding conductor (e.g., primary winding conductor/secondary winding conductor) 102 and the second winding conductors (e.g., secondary winding conductors/primary winding conductors) 104, 106 can be effectively increased by the aforementioned arrangement, the transformer-based circuit 100 with better coupling efficiency and less coupling loss is realized. It should be noted that the aforementioned arrangement of the first winding conductor 102 and the second winding conductors 104, 106 is for illustrative purpose only. That is, any transformer-based circuit employing one or more of the exemplary layout pattern designs of the winding conductors falls within the scope of the present invention.

In the following, features of the layout pattern designs of the winding conductors implemented in a transformer-based circuit are detailed.

As shown in FIG. 1, each loop 212, 214 of the first winding conductor 102 is magnetically coupled by all of the second winding conductors 104 and 106. That is, the second winding conductors 104, 106 and all of the loops 212, 214 of the first winding conductor 102 are fully twisted together. Please note that this term "twist" is to define an overall shape of the exemplary transformer-based circuit of the present invention. That is, the transformer-based circuit has a twist shape when viewed as a whole. More specifically, as can be seen from the top view of the exemplary transformer-based circuit of the present invention, the second winding conductors are sequentially coupled to loops of the first winding conductor to therefore have a twist shape; however, it should be noted that each individual second winding conductor is arranged to propagate along a corresponding loop of the first winding conductor instead of being twisted around the corresponding loop of the first winding conductor.

Furthermore, as shown in FIG. 1, each loop 212, 214 of the first winding conductor 102 is fully coupled (or surrounded) by all of the second winding conductors 104, 106. More specifically, in this exemplary embodiment, each loop 212, 214 of the first winding conductor 102 is evenly coupled by the second winding conductors 104, 106. For instance, regarding the exemplary embodiment shown in FIG. 1, one half of the loop 214 formed by the sector 204 is magnetically coupled by the sector 304 of the second winding conductor 104, and the other half of the loop 214 formed by the sector 204 is magnetically coupled by the sector 404 of the second winding conductor 106. However, this is for illustrative purposes only, and is not meant to be a limitation to the scope of the present invention. Any transformer-based circuit employing second winding conductors with the same layout pattern and/or symmetrical layout patterns obeys the spirit of the present invention.

In the following, the number of loops of the first winding conductor is denoted by M, and the number of second winding conductors is denoted by N (i.e., N=2), where M/N is an integer. In this exemplary embodiment, the number of the loops 212, 214 of the first winding conductor 102 is two (M=2), and the number of the second winding conductors 104, 106 is two (N=2). In addition, every two successively connected sectors of the second winding conductor 104, 106 are magnetically coupled to different loops of the first winding conductor 102. For example, sectors 302 and 304 are magnetically coupled to adjacent loops 212 and 214, respectively; sectors 304 and 306 are magnetically coupled to adjacent loops 214 and 212, respectively; sectors 402 and 404 are magnetically coupled to adjacent loops 212 and 214, respectively; sectors 404 and 406 are magnetically coupled to adjacent loops 214 and 212, respectively.

By way of example, but not limitation, the loops 212, 214 are concentric circular loops. A unit circular angle θ is therefore defined as $$\frac{360^\circ}{K \cdot N},$$

where K is an even number. Each of the sectors of the second winding conductor 104, 106 propagates along a corresponding magnetically coupled loop to thereby have a propagation path corresponding to an integral multiple of the unit circular angle (i.e., n*θ, where n is a positive integer) with respect to a specific point (e.g., a center C of the concentric circular loops), substantially. In view of above, the exemplary embodiment shown in FIG. 1 has following parameter settings: M=2, N=2 and K=2. Therefore, the unit circular angle θ is equal to 90°

$$\left(\theta = \frac{360^\circ}{2 \cdot 2} = 90^\circ\right).$$

Regarding the second winding conductor 104 as shown in FIG. 3, provided that the size of the winding conductor crossing part is small and negligible, the sector 302 propagates along the corresponding magnetically coupled loop 212 to thereby have a propagation path corresponding to one unit circular angle (i.e., 90°), substantially; the sector 304 serially connected to the sector 302 propagates along the corresponding magnetically coupled loop 214 to thereby have a propagation path corresponding to two unit circular angles (i.e., 180°), substantially; and the sector 306 serially connected to the sector 304 propagates along the corresponding magnetically coupled loop 212 to thereby have a propagation path corresponding to one unit circular angle (i.e., 90°), substantially. Regarding the second winding conductor 106 as shown in FIG. 4, provided that the size of the winding conductor crossing part is small and negligible, the sector 402 propagates along the corresponding magnetically coupled loop 212 to thereby have a propagation path corresponding to one unit circular angle (i.e., 90°), substantially; the sector 404 serially connected to the sector 402 propagates along the corresponding magnetically coupled loop 214 to have a propagation path corresponding to two unit circular angles (i.e., 180°), substantially; and the sector 406 serially connected to the sector 404 propagates along the corresponding magnetically coupled loop 212 to thereby have a propagation path corresponding to one unit circular angle (i.e., 90°), substantially.

More specifically, the leading sector and the last sector (i.e., 302 and 306) are both magnetically coupled to an outer-most loop of the first winding conductor 102, the sectors of the second winding conductor 104 include sectors 302, 306 each propagating along a corresponding magnetically coupled loop of the first winding conductor 102 to thereby have a propagation path substantially corresponding to a single unit circular angle and a sector 304 propagating along an inner-most loop of the loops 212, 214 to thereby have a propagation path substantially corresponding to multiple unit circular angles, and the sectors of the second winding conductor 106 include sectors 402, 406 each propagating along a corresponding magnetically coupled loop of the first winding conductor 102 to thereby have a propagation path substantially corresponding to a single unit circular angle and a sector 404 propagating along an inner-most loop of the loops 212, 214 to thereby have a propagation path substantially corresponding to multiple unit circular angles. Furthermore, the sectors 302, 304, 306 of the second winding conductor 104 are successively and magnetically coupled to the loops 212, 214 from the outer-most loop (i.e., 212) to the inner-most loop (i.e., 214) in an inward direction and then from the inner-most loop (i.e., 214) to the outer-most loop (i.e., 212) in an outward direction. That is, the sector 302 with one end directly connected to the terminal T1 of the second port P2_1 is configured to be magnetically coupled to the loop 212 which is the outer-most loop, the sector 304 with one end directly connected to the sector 302 is configured to be magnetically coupled to the loop 214 which is the inner-most loop, and the sector 306 with one end directly connected to the sector 304 and the other end directly connected to the other terminal T2 of the second port P2_1 is configured to be magnetically coupled to the loop 212. Similarly, with regard to the second winding conductor 106, the sector 402 with one end directly connected to the terminal T3 of the second port P2_2 is configured to be magnetically coupled to the loop 212 which is the outer-most loop, the sector 404 with one end directly connected to the sector 402 is configured to be magnetically coupled to the loop 214 which is also the inner-most loop, and the sector 406 with one end directly connected to the sector 404 and the other end directly connected to the other terminal T4 of the second port P2_2 is configured to be magnetically coupled to the loop 212.

In another embodiment where the leading sector and the last sector of the second winding conductor are both magnetically coupled to an inner-most loop of the loops (for example, the second winding conductor 104 shown in FIG. 1 is replaced by the second winding conductor 602 shown in FIG. 6, and the second winding conductor 106 shown in FIG. 1 is replaced by the second winding conductor 702 shown in FIG. 6), the sectors of the second winding conductor 602 would include first sectors each propagating along a corresponding magnetically coupled loop of the first winding conductor 102 to thereby have a propagation path substantially corresponding to a single unit circular angle and a second sector propagating along an outer-most loop of the loops 212, 214 to thereby have a propagation path substantially corresponding to multiple unit circular angles, and the sectors of the second winding conductor 702 would include first sectors each propagating along a corresponding magnetically coupled loop of the first winding conductor 102 to thereby have a propagation path substantially corresponding to a single unit circular angle and a second sector propagating along an outer-most loop of the loops 212, 214 to thereby have a propagation path substantially corresponding to multiple unit circular angles. As a person skilled in the art would readily understand details of such an alternative design after reading above paragraphs, further description is omitted here for brevity.

Figure 9:
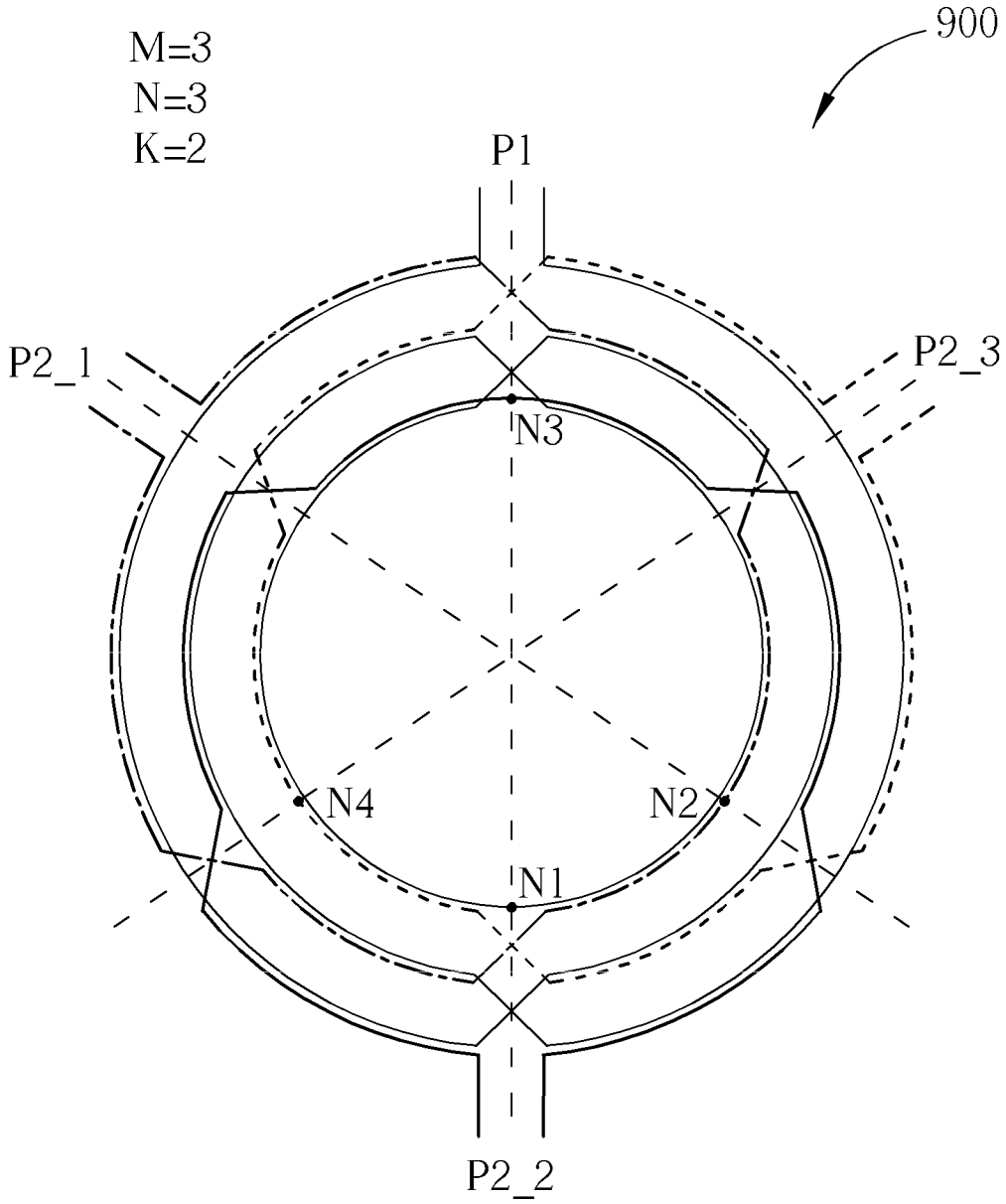
FIG. 9 is a diagram illustrating an exemplary transformer-based circuit according to the present invention.

As mentioned above, each of the second winding conductors 104, 106 of the transformer-based circuit 100 has only one sector propagating along an outer-most loop/inner-most loop of the loops 212, 214 to have a propagation path substantially corresponding to multiple unit circular angles. Besides, the parameters M, N, and K would decide the finalized layout patterns of the second winding conductors 104, 106. In accordance with the design rule mentioned above, FIG. 9-FIG. 13 therefore show a plurality of other exemplary embodiments of a transformer-based circuit according to the present invention, respectively. Specifically, the exemplary transformer-based circuit 900 in FIG. 9 with the parameter settings M=3, N=3, and K=2 has one first port P1 and three second ports P2_1, P2_2, P2_3, where a unit circular angle thereof is equal to 60°

$$\left(\frac{360^\circ}{2\cdot 3}=60^\circ\right).$$

The exemplary transformer-based circuit 900 can be a 1-to-3 transformer power splitter, where node N1 acts as a center-tap node of the primary winding conductor; in addition, the exemplary transformer-based circuit 900 can also be a 3-to-1 transformer power combiner, where nodes N2, N3, N4 act as center-tap nodes of the respective primary winding conductors.

Figure 10:
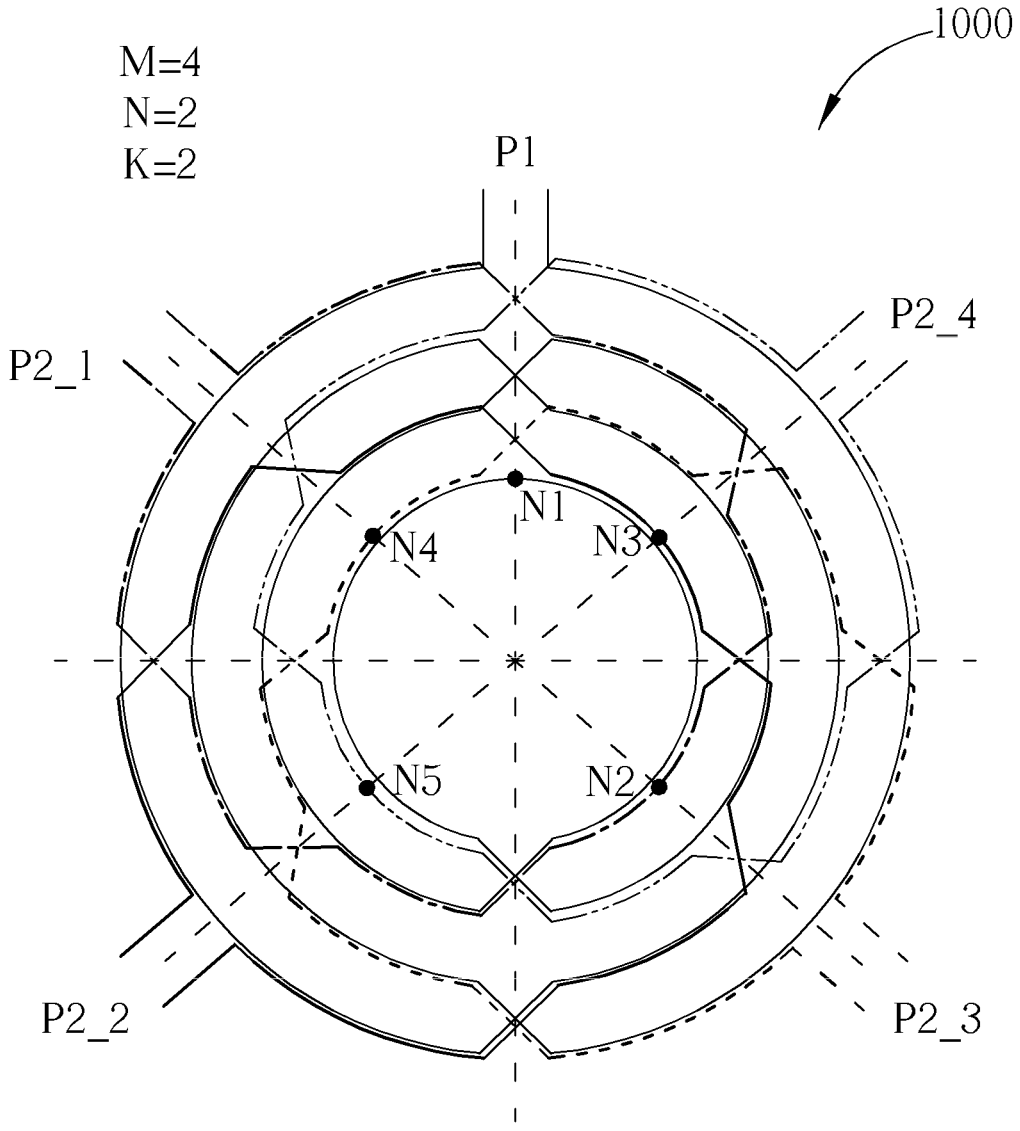
FIG. 10 is a diagram illustrating an exemplary transformer-based circuit according to the present invention.

The exemplary transformer-based circuit 1000 in FIG. 10 with the parameter settings M=4, N=4, and K=2 has one first port P1 and four second ports P2_1, P2_2, P2_3, P2_4, where a unit circular angle thereof is equal to 45°

$$\left(\frac{360^\circ}{2\cdot 8}=45^\circ\right).$$

The exemplary transformer-based circuit 1000 can be a 1-to-4 transformer power splitter, where node N1 acts as a center-tap node of the primary winding conductor; in addition, the exemplary transformer-based circuit 1000 can also be a 4-to-1 transformer power combiner, where nodes N2, N3, N4, N5 act as center-tap nodes of the respective primary winding conductors.

Figure 11:
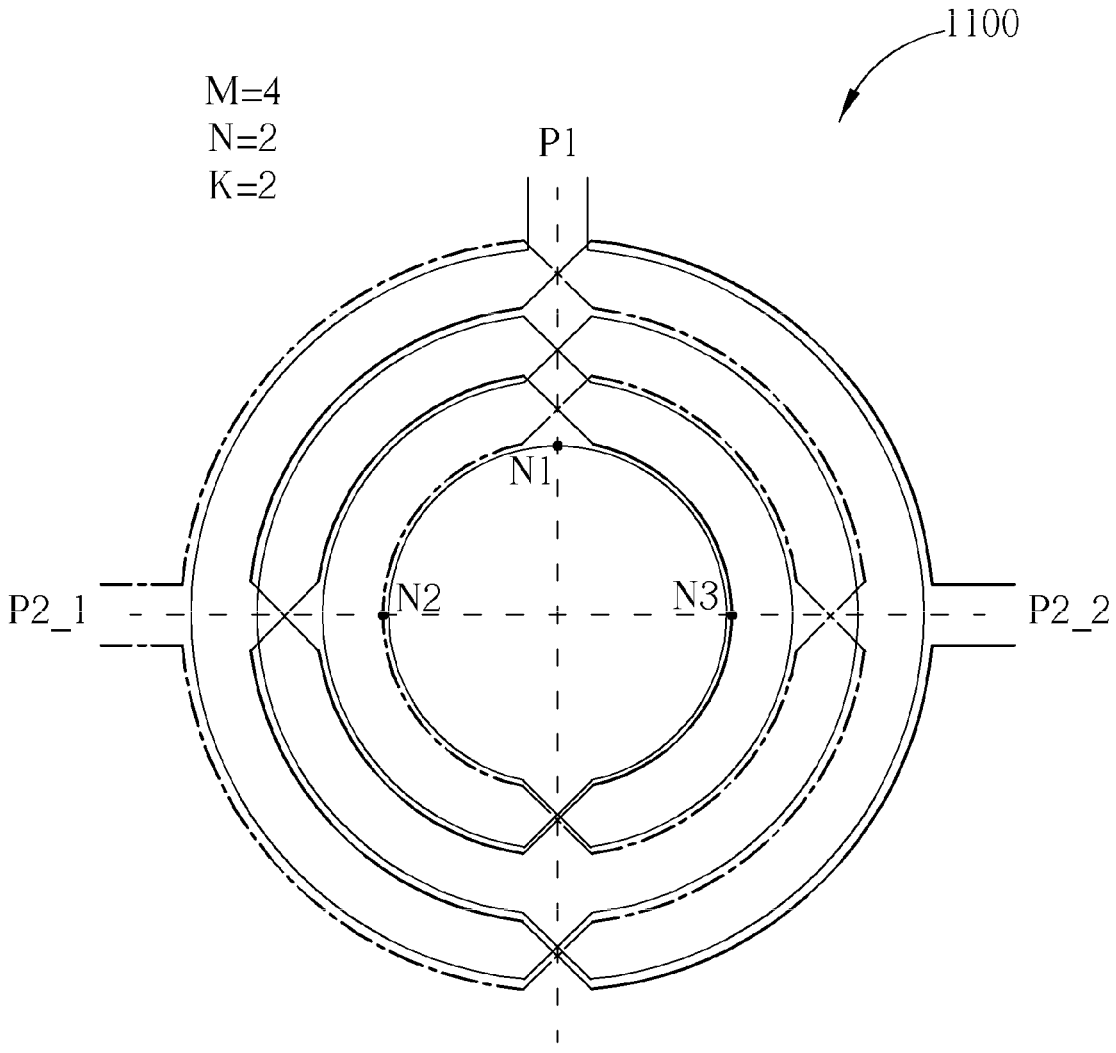
FIG. 11 is a diagram illustrating an exemplary transformer-based circuit according to the present invention.

The exemplary transformer-based circuit 1100 in FIG. 11 with the parameter settings M=4, N=2, and K=2 has one first port P1 and two second ports P2_1, P2_2, where a unit circular angle thereof is equal to 90°

$$\left(\frac{360^\circ}{2\cdot 2}=90^\circ\right).$$

The exemplary transformer-based circuit 1100 can be a 1-to-2 transformer power splitter, where node N1 acts as a center-tap node of the primary winding conductor; in addition, the exemplary transformer-based circuit 1100 can also be a 2-to-1 transformer power combiner, where nodes N2, N3 act as center-tap nodes of the respective primary winding conductors.

Figure 12:
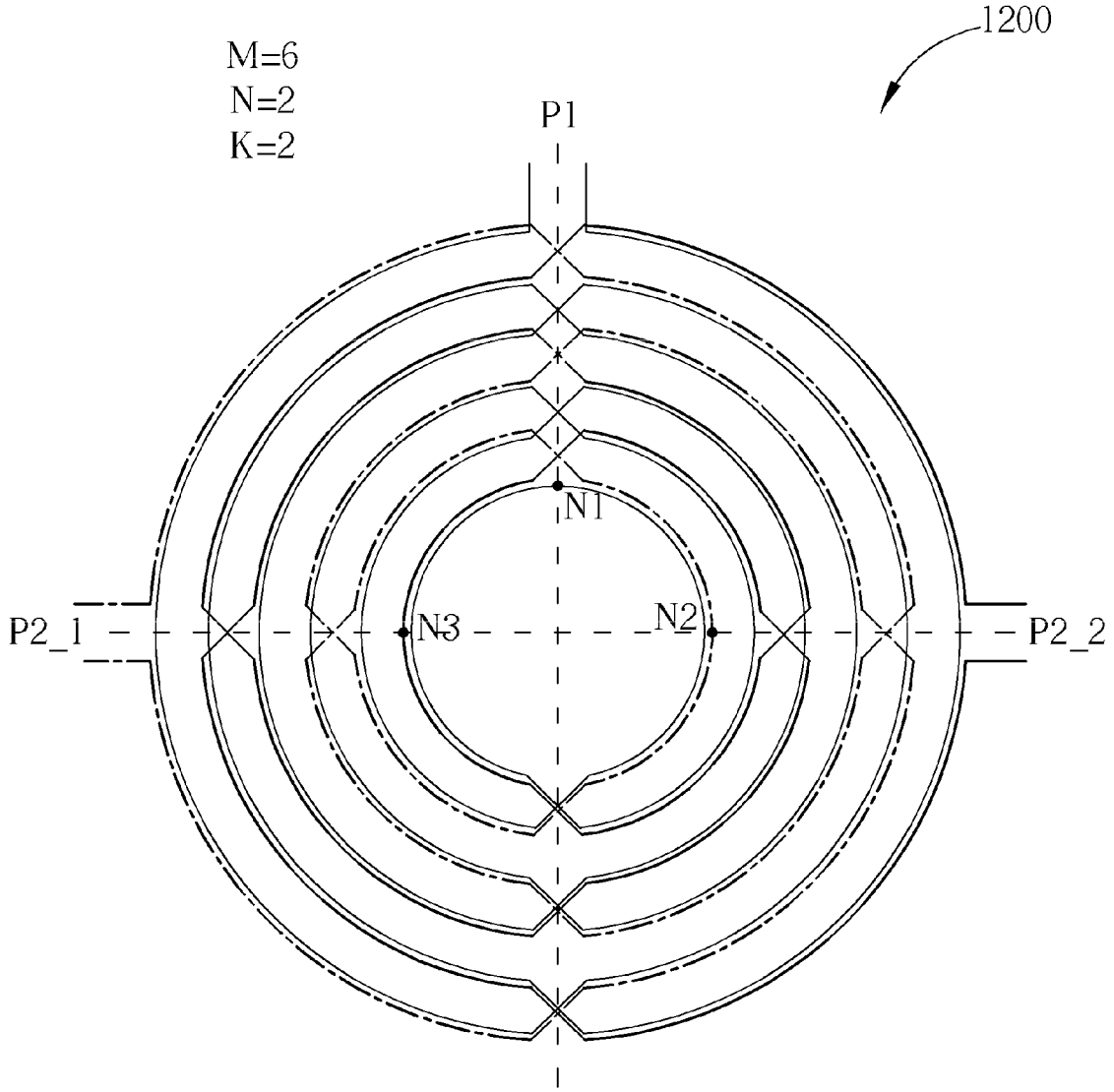
FIG. 12 is a diagram illustrating an exemplary transformer-based circuit according to the present invention.

The exemplary transformer-based circuit 1200 in FIG. 12 with the parameter settings M=6, N=2, and K=2 has one first port P1 and two second ports P2_1, P2_2, where a unit circular angle thereof is equal to 90°

$$\left(\frac{360^\circ}{2\cdot 2}=90^\circ\right).$$

The exemplary transformer-based circuit 1200 can be a 1-to-2 transformer power splitter, where node N1 acts as a center-tap node of the primary winding conductor; in addition, the exemplary transformer-based circuit 1200 can also be a 2-to-1 transformer power combiner, where nodes N2, N3 act as center-tap nodes of the respective primary winding conductors.

Figure 13:
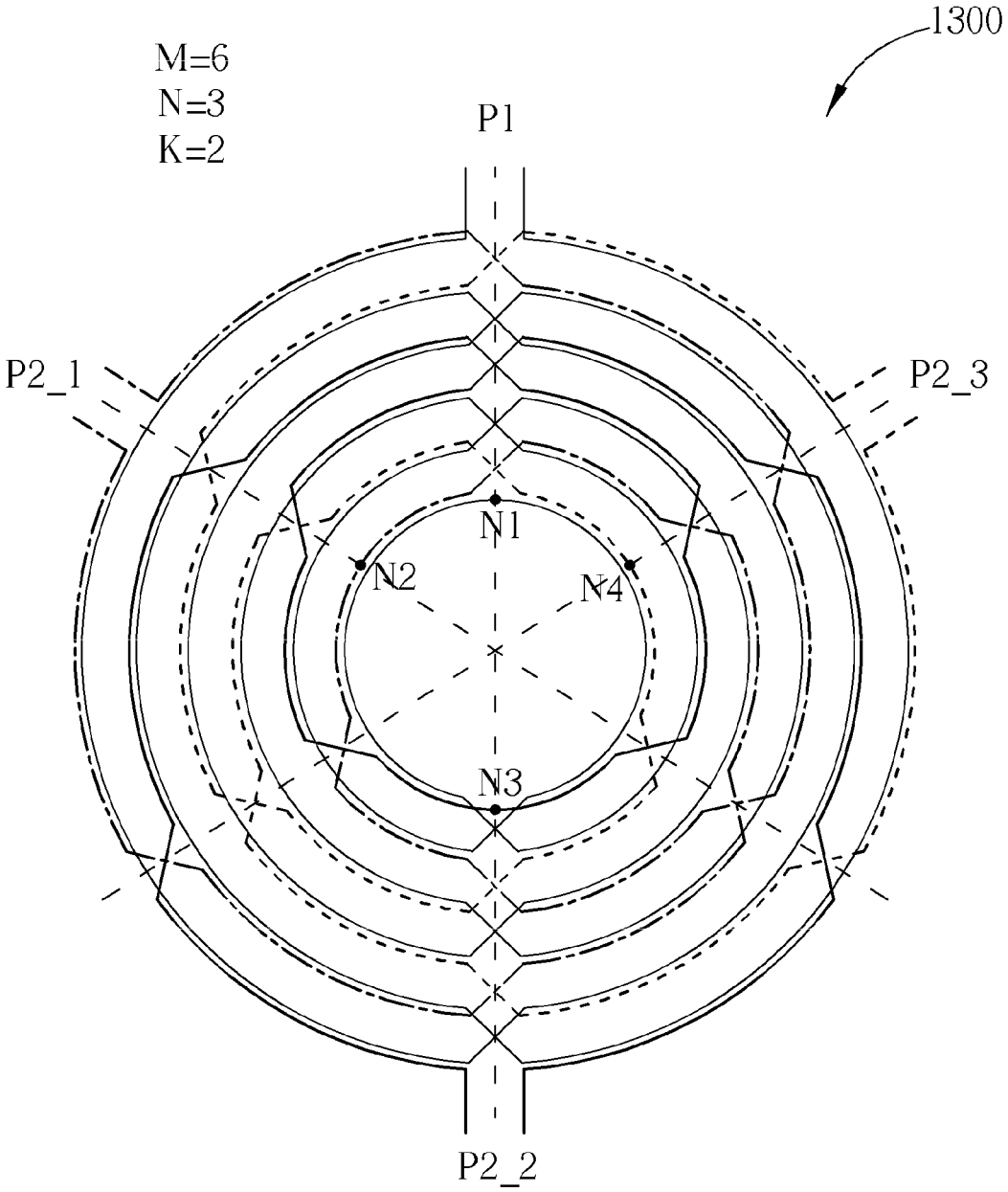
FIG. 13 is a diagram illustrating an exemplary transformer-based circuit according to the present invention.

The exemplary transformer-based circuit 1300 in FIG. 13 with the parameter settings M=6, N=3, and K=2 has one first port P1 and three second ports P2_1, P2_2, P2_3, where a unit circular angle thereof is equal to 60°

$$\left(\frac{360^\circ}{2\cdot 3}=60^\circ\right).$$

The exemplary transformer-based circuit 1300 can be a 1-to-3 transformer power splitter, where node N1 acts as a center-tap node of the primary winding conductor; in addition, the exemplary transformer-based circuit 1300 can also be a 3-to-1 transformer power combiner, where nodes N2, N3, N4 act as center-tap nodes of the respective primary winding conductors.

In above illustrated examples, each of the second winding conductors of the transformer-based circuit has only one sector propagating along an outer-most loop (if the leading sector and the last sector of the second winding conductor are both magnetically coupled to an inner-most loop of the first winding conductor) or an inner-most loop (if the leading sector and the last sector of the second winding conductor are both magnetically coupled to an outer-most loop of the first winding conductor) of the first winding conductor to thereby have a propagation path substantially corresponding to multiple unit circular angles. In yet another exemplary transformer-based circuits of the present invention, each of the second winding conductors has a plurality of sectors each propagating along an outer-most loop (if the leading sector and the last sector of the second winding conductor are both magnetically coupled to an inner-most loop of the first winding conductor) or an inner-most loop (if the leading sector and the last sector of the second winding conductor are both magnetically coupled to an outer-most loop of the first winding conductor) of the first winding conductor to thereby have a propagation path substantially corresponding to multiple unit circular angles, and at least one sector propagating along an inner-most loop (if the leading sector and the last sector of the second winding conductor are both magnetically coupled to an inner-most loop of the first winding conductor) or an outer-most loop (if the leading sector and the last sector of the second winding conductor are both magnetically coupled to an outer-most loop of the first winding conductor) of the first winding conductor to thereby have a propagation path substantially corresponding to multiple unit circular angles. To more clearly describe features mentioned above, certain examples are given as below.

Figure 14:
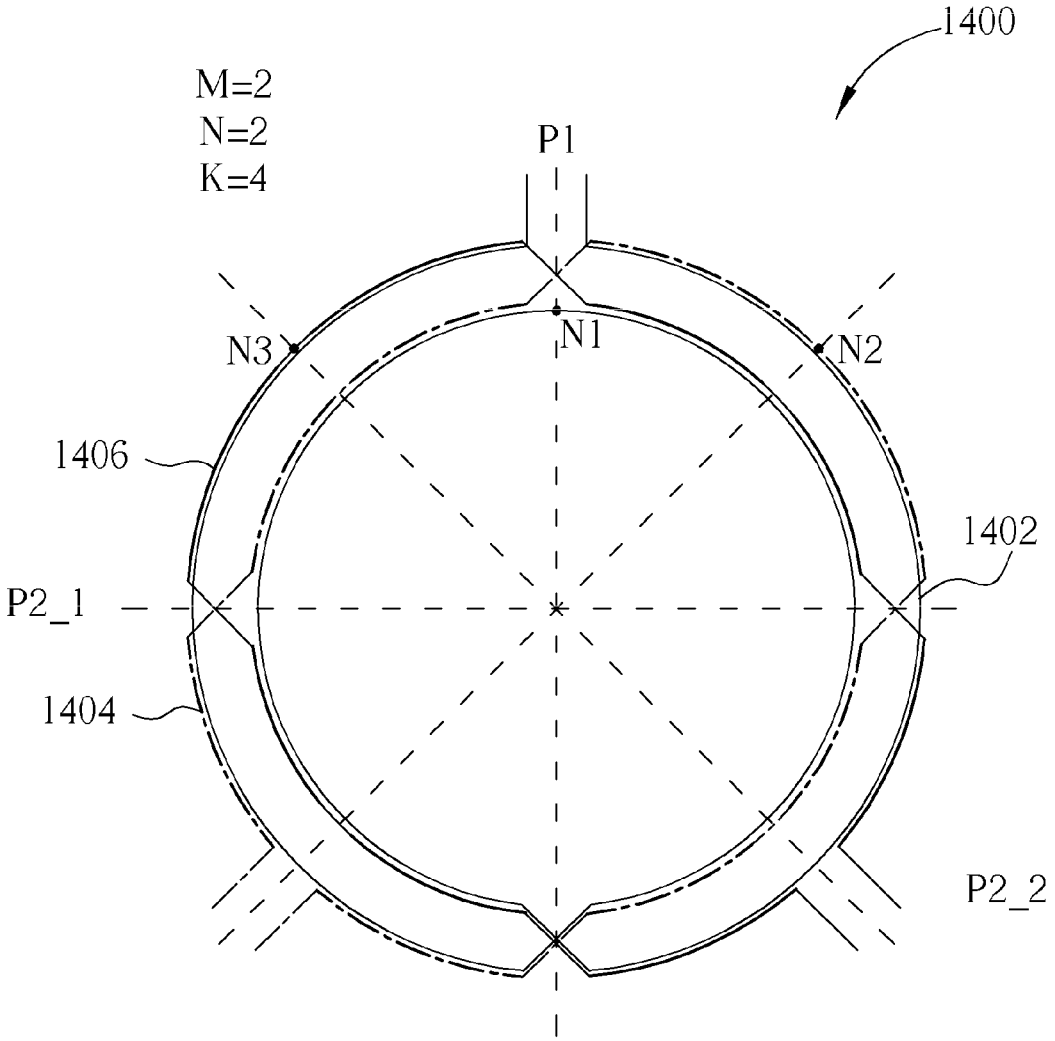
FIG. 14 is a diagram illustrating an exemplary transformer-based circuit according to the present invention.

Taking the exemplary embodiment shown in FIG. 14 for example, the transformer-based circuit 1400 with the parameter settings M=2, N=2, and K=4 has one first port P1 and two second ports P2_1, P2_2, where a unit circular angle thereof is equal to 45°

$$\left(\frac{360^\circ}{4\cdot 2}=45^\circ\right).$$

Figure 15:
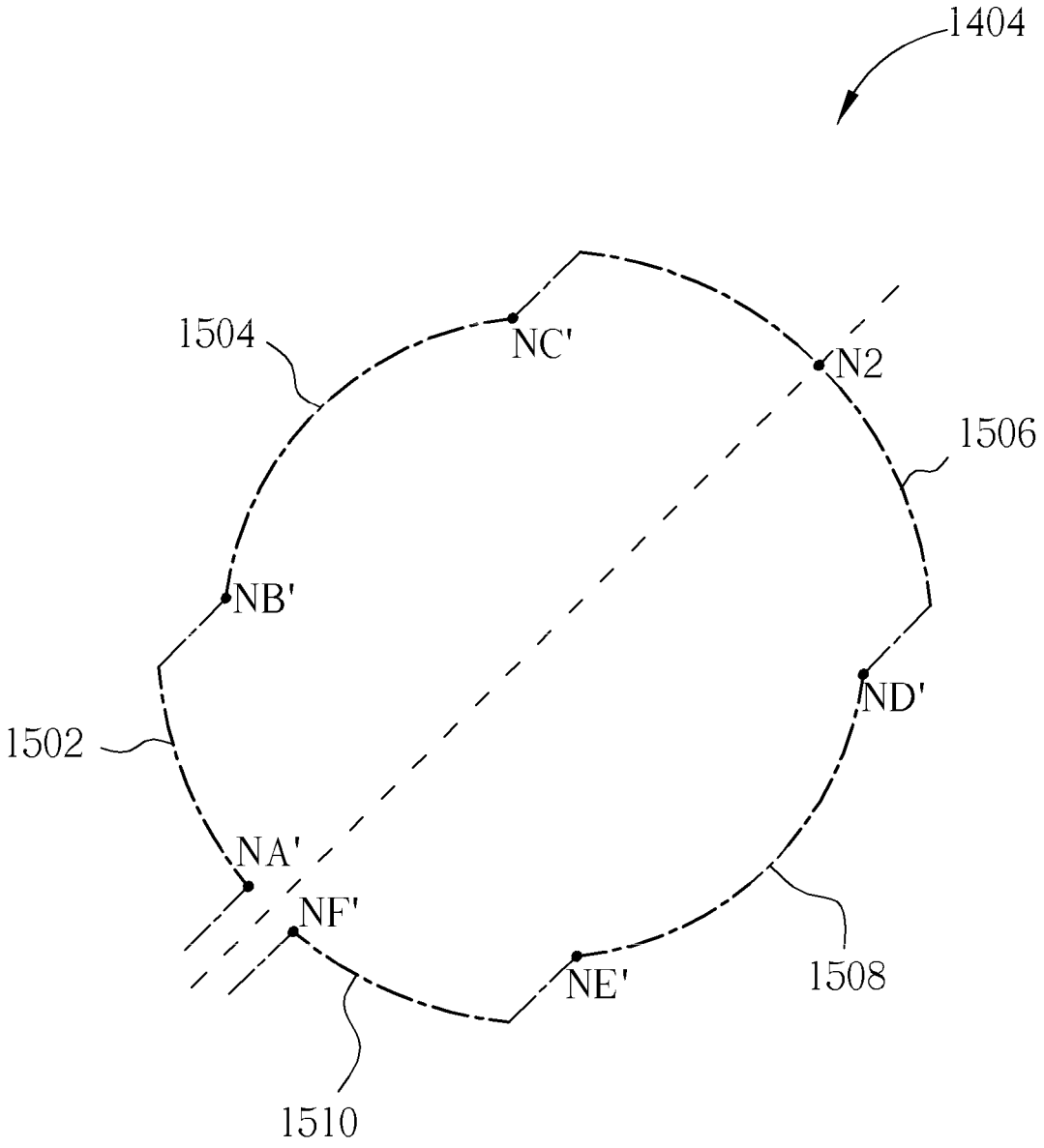
FIG. 15 is a diagram illustrating a layout pattern of one second winding conductor shown in FIG. 14.
Figure 16:
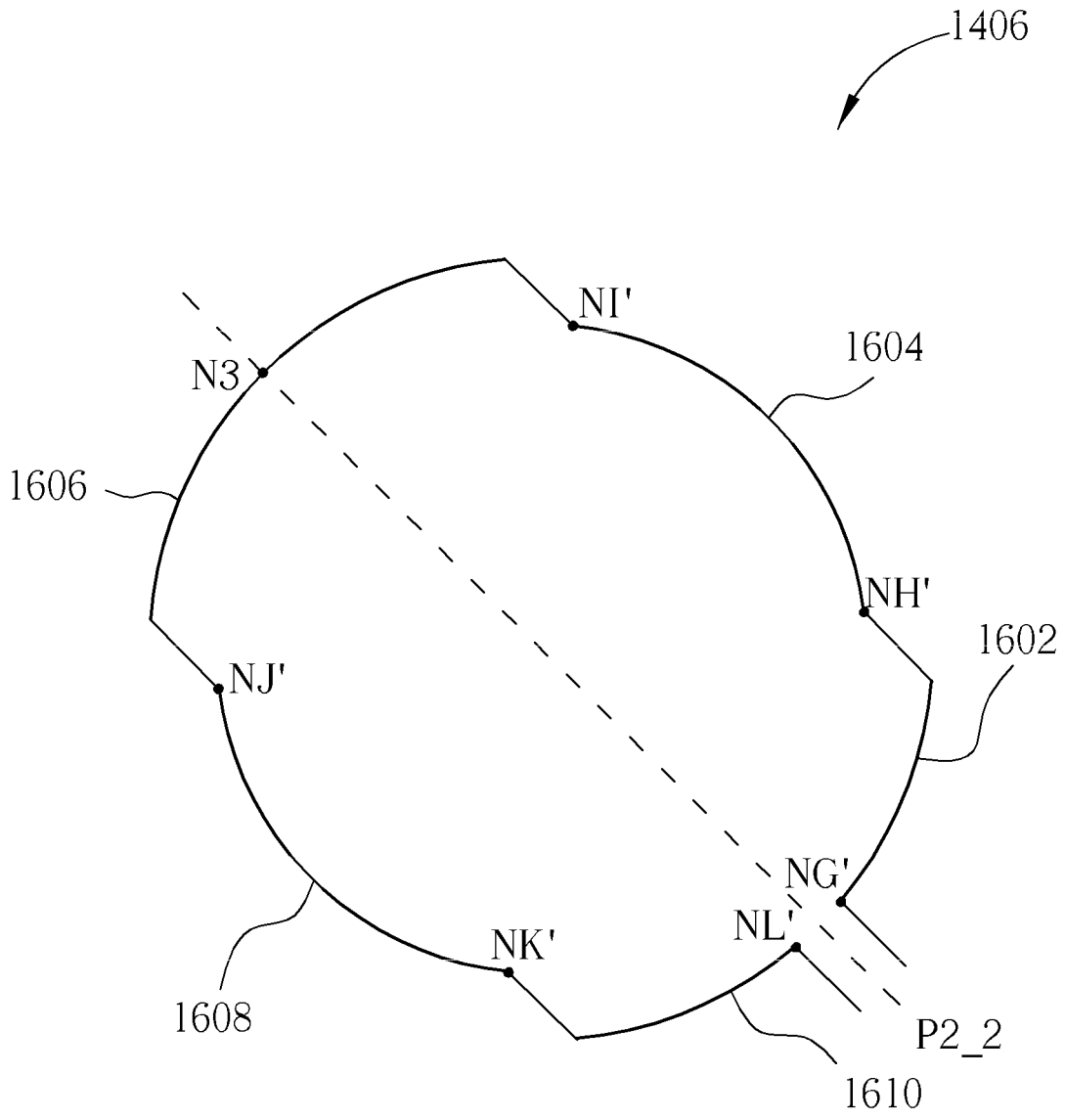
FIG. 16 is a diagram illustrating a layout design of the other second winding conductor shown in FIG. 14.

In addition, the transformer-based circuit 1400 includes a first winding conductor 1402 and two second winding conductors 1404, 1406. For clarity, the layout patterns of the second winding conductors 1404, 1406 are shown in FIG. 15 and FIG. 16, respectively. Please note that the layout pattern of the first winding conductor 1402 is substantially identical to that shown in FIG. 2, and further description is omitted here for brevity. As shown in FIG. 15, the second winding conductor 1404 includes sectors 1502, 1504, 1506, 1508, 1510 connected in series, where each of the sectors 1502 and 1510 propagates along a corresponding magnetically coupled loop (e.g., the outer-most loop) of the first winding conductor 1402 to thereby have a propagation path substantially corresponding to a single unit circular angle, each of the sectors 1504 and 1508 propagates along an inner-most loop of the first winding conductor 1402 to thereby have a propagation path substantially corresponding to two unit circular angles, and the sector 1506 propagates along the outer-most loop of the first winding conductor 1402 to thereby have a propagation path substantially corresponding to two unit circular angles. As can be seen from FIG. 15, the sector 1502 has two ends terminated at nodes NA' and NB', respectively; the sector 1504 has two ends terminated at nodes NB' and NC', respectively; the sector 1506 has two ends terminated at nodes NC' and ND', respectively; the sector 1508 has two ends terminated at nodes ND' and NE', respectively; and the sector 1510 has two ends terminated at nodes NE' and NF', respectively. It should be noted that the illustrated segmentation applied to the second winding conductor 1404 merely serves one possible implementation, and should not be treated as a limitation to the scope of the present invention. With regard to the second winding conductor 1406 as shown in FIG. 16, it include sectors 1602, 1604, 1606, 1608, 1610 connected in series, where each of the sectors 1602 and 1610 propagates along a corresponding magnetically coupled loop (e.g., the outer-most loop) of the first winding conductor 1402 to thereby have a propagation path substantially corresponding to a single unit circular angle, each of the sectors 1604 and 1608 propagates along an inner-most loop of the first winding conductor 1402 to thereby have a propagation path substantially corresponding to two unit circular angles, and the sector 1606 propagates along the outer-most loop of the first winding conductor 1402 to thereby have a propagation path substantially corresponding to two unit circular angles. As can be seen from FIG. 16, the sector 1602 has two ends terminated at nodes NG' and NH', respectively; the sector 1604 has two ends terminated at nodes NH' and NI', respectively; the sector 1606 has two ends terminated at nodes NI' and NJ', respectively; the sector 1608 has two ends terminated at nodes NJ' and NK', respectively; and the sector 1610 has two ends terminated at nodes NK' and NL'. It should be noted that the illustrated segmentation applied to the second winding conductor 1406 merely serves one possible implementation, and should not be treated as a limitation to the scope of the present invention.

Please refer to FIG. 14 in conjunction with FIG. 15 and FIG. 16, the sectors 1502, 1504, 1506, 1508, 1510 of the second winding conductor 1404 are successively and magnetically coupled to the loops from the outer-most loop to the inner-most loop in an inward direction and then from the inner-most loop to the outer-most loop in an outward direction, repeatedly. Similarly, the sectors 1602, 1604, 1606, 1608, 1610 of the second winding conductor 1406 are successively and magnetically coupled to the loops from the outer-most loop to the inner-most loop in an inward direction and then from the inner-most loop to the outer-most loop in an outward direction, repeatedly.

Figure 17:
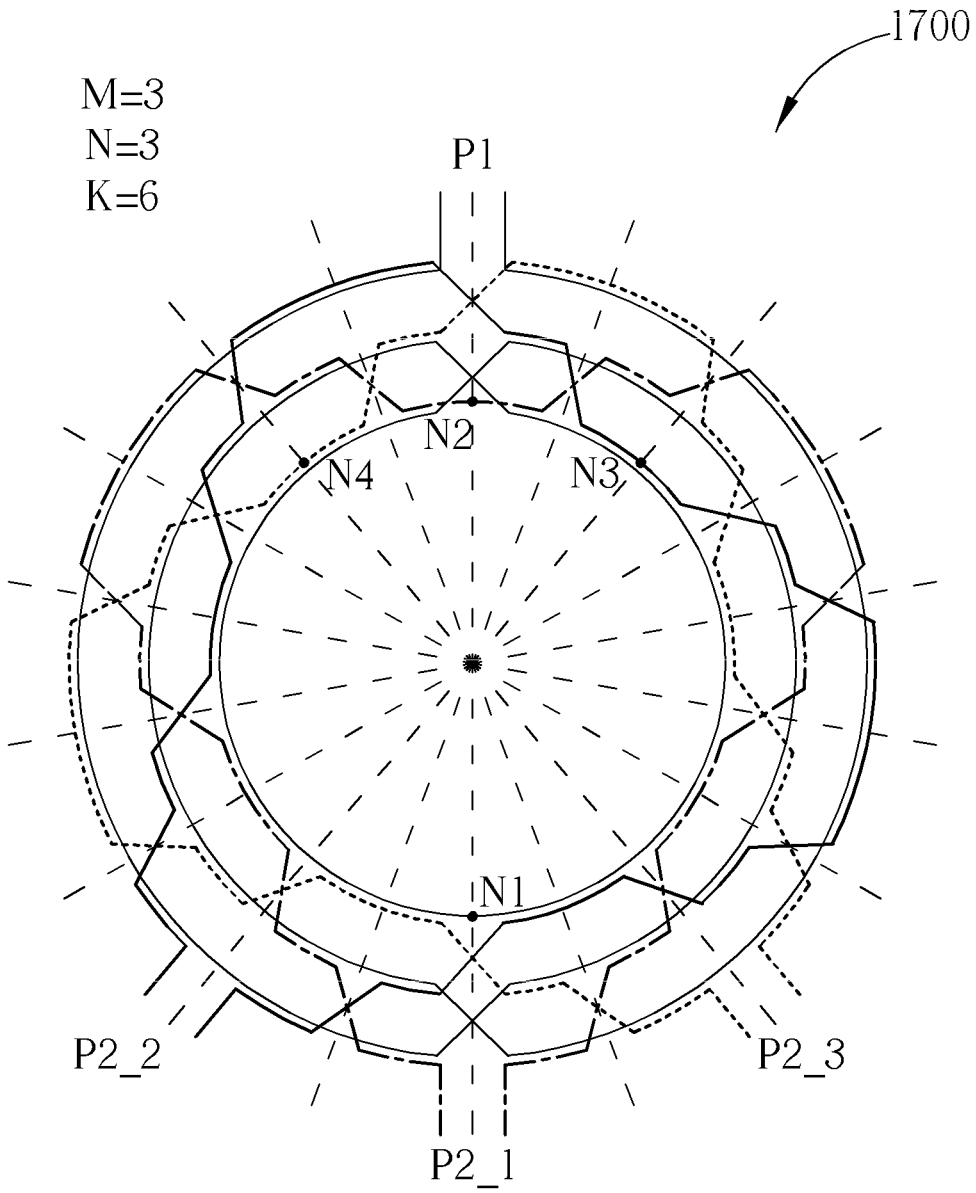
FIG. 17 is a diagram illustrating an exemplary transformer-based circuit according to the present invention.

As mentioned above, the parameters M, N, and K decide the finalized layout patterns of the second winding conductors included in a transformer-based circuit. In accordance with the design rule mentioned above, FIG. 17 and FIG. 18 therefore show other exemplary embodiments of a transformer-based circuit according to the present invention, respectively. Specifically, the exemplary transformer-based circuit 1700 in FIG. 17 with the parameter settings M=3, N=3, and K=6 has one first port P1 and three second ports P2_1, P2_2, P2_3, where a unit circular angle thereof is equal to 20°

$$\left(\frac{360^\circ}{6\cdot 3}=20^\circ\right).$$

The exemplary transformer-based circuit 1700 can be a 1-to-3 transformer power splitter, where node N1 acts as a center-tap node of the primary winding conductor; in addition, the exemplary transformer-based circuit 1700 can also be a 3-to-1 transformer power combiner, where nodes N2, N3, N4 act as center-tap nodes of the respective primary winding conductors.

Figure 18:
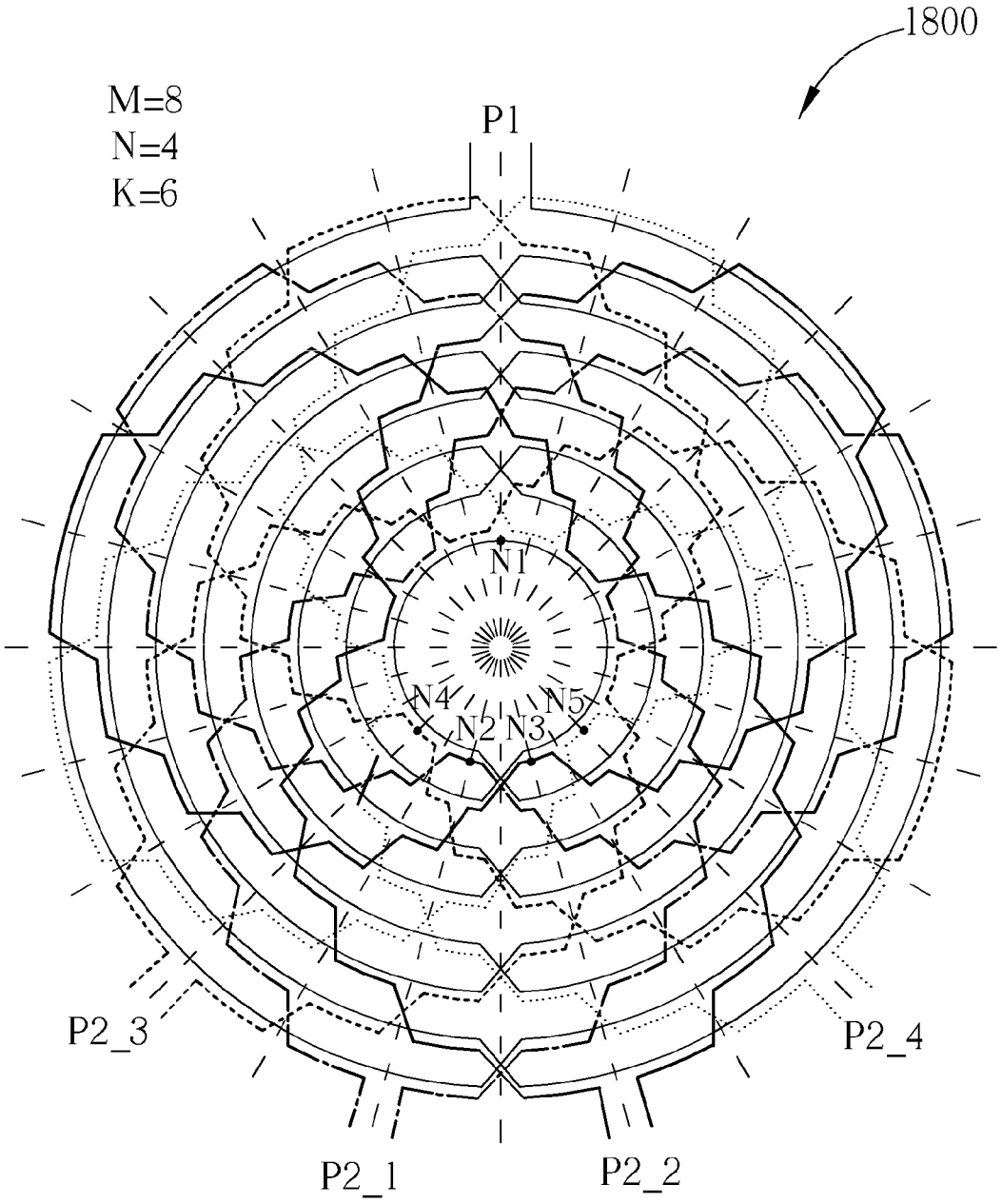
FIG. 18 is a diagram illustrating an exemplary transformer-based circuit according to the present invention.

The exemplary transformer-based circuit 1800 in FIG. 18 with the parameter settings M=8, N=4, and K=6 has one first port P1 and four second ports P2_1, P2_2, P2_3, P2_4, where a unit circular angle thereof is equal to 15°

$$\left(\frac{360^\circ}{6\cdot 4}=15^\circ\right).$$

The exemplary transformer-based circuit 1800 can be a 1-to-4 transformer power splitter, where node N1 acts as a center-tap node of the primary winding conductor; in addition, the exemplary transformer-based circuit 1800 can also be a 4-to-1 transformer power combiner, where nodes N2, N3, N4, N5 act as center-tap nodes of the respective primary winding conductors.

Please note that modifications made to the exemplary embodiments shown in FIG. 9-FIG. 14, FIG. 17, and FIG. 18 without departing from the spirit of the present invention are feasible. For example, the first winding conductor can be modified according to teachings of the alternative design shown in FIG. 5, and/or each second winding conductor can be modified according to teachings of the alternative design shown in FIG. 6/FIG. 7. In addition, as mentioned above, the loops formed by routing sectors of the first winding conductor are concentric circular loops, preferably. However, it should be noted that no matter whether the loops formed by routing sectors of the first winding conductor are concentric circular loops, any transformer-based circuit having particular winding conductor layout patterns devised for compactness and/or symmetry (e.g., the first and second winding conductors each having a symmetrical layout patter, the second winding conductors each having the same layout pattern, and/or the second winding conductors and loops of the first winding conductor) fully twisted together falls within the scope of the present invention.

To put it simply, the design rule for configuring the overall layout pattern of each second winding conductor is summarized as follows. Start from one terminal of a second port of a second winding conductor at an outer-most (inner-most) loop of a first winding conductor in a clockwise or counterclockwise direction; and perform the following sequence of steps (a)-(d) one or multiple times until ending up at the other terminal of the second port of the second winding conductor: (a) after every moving of one unit circular angle, making a jump to the next inner (outer) loop of the first winding conductor; (b) continuing inward (outward) loop jump(s) for every moving of one unit circular angle until arriving the inner-most (outer-most) loop of the first winding conductor; (c) at the inner-most (outer-most) loop of the first winding conductor, moving for multiple unit circular angles (e.g., two unit circular angles) and then making a jump to the next outer (inner) loop of the first winding conductor; and (d) continuing outward (inward) loop jumps for every moving of one unit circular angle until arriving the outer-most (inner-most) loop of the first winding conductor.

Please note that in a special case where the condition $K \cdot N \geq M$ is met, the overall layout pattern of each second winding conductor can be alternatively configured using another design rule different from that mentioned above. Please refer to FIG. 19, which illustrates another exemplary embodiment of a transformer-based circuit according to the present invention. The transformer-based circuit 1900 with the parameter settings M=4, N=2, and K=4 has one first port P1 and two second ports P2_1, P2_2, where $K \cdot N \geq M$ is met, and a unit circular angle thereof is equal to 45°

$$\left(\frac{360^\circ}{4 \cdot 2} = 45^\circ\right).$$

Figure 20:
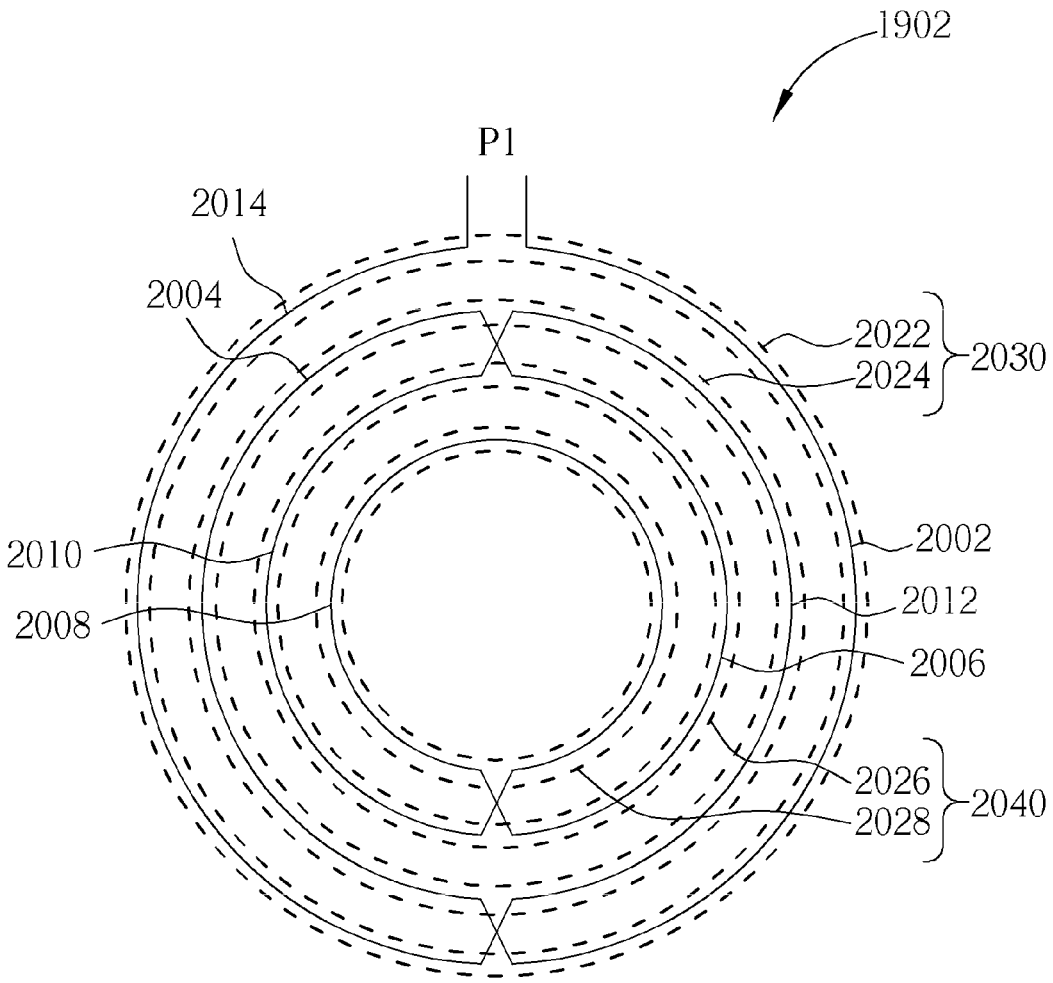
FIG. 20 is a diagram illustrating a layout pattern of a first winding conductor shown in FIG. 20.
Figure 21:
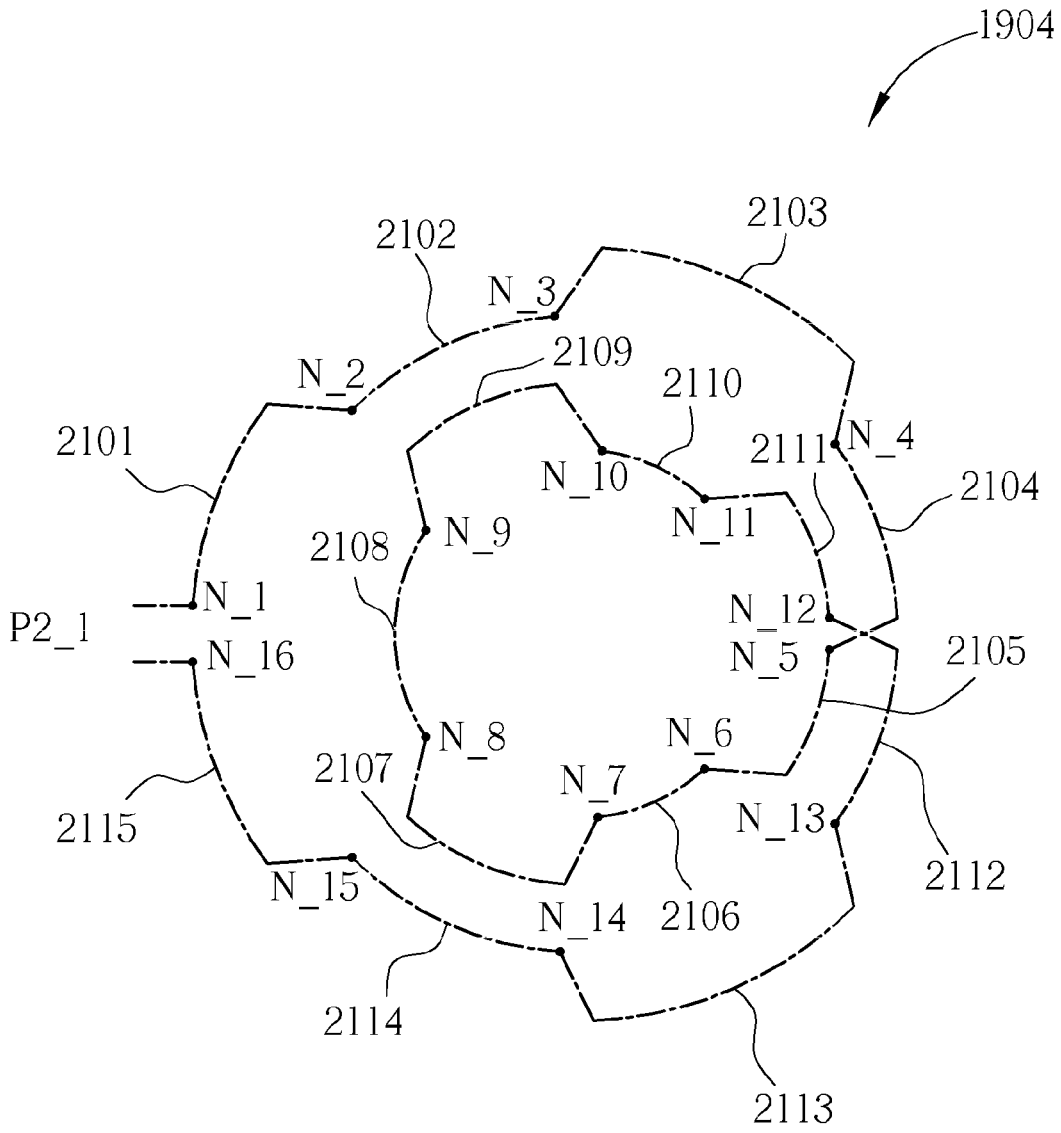
FIG. 21 is a diagram illustrating a layout pattern of one second winding conductor shown in FIG. 20.
Figure 22:
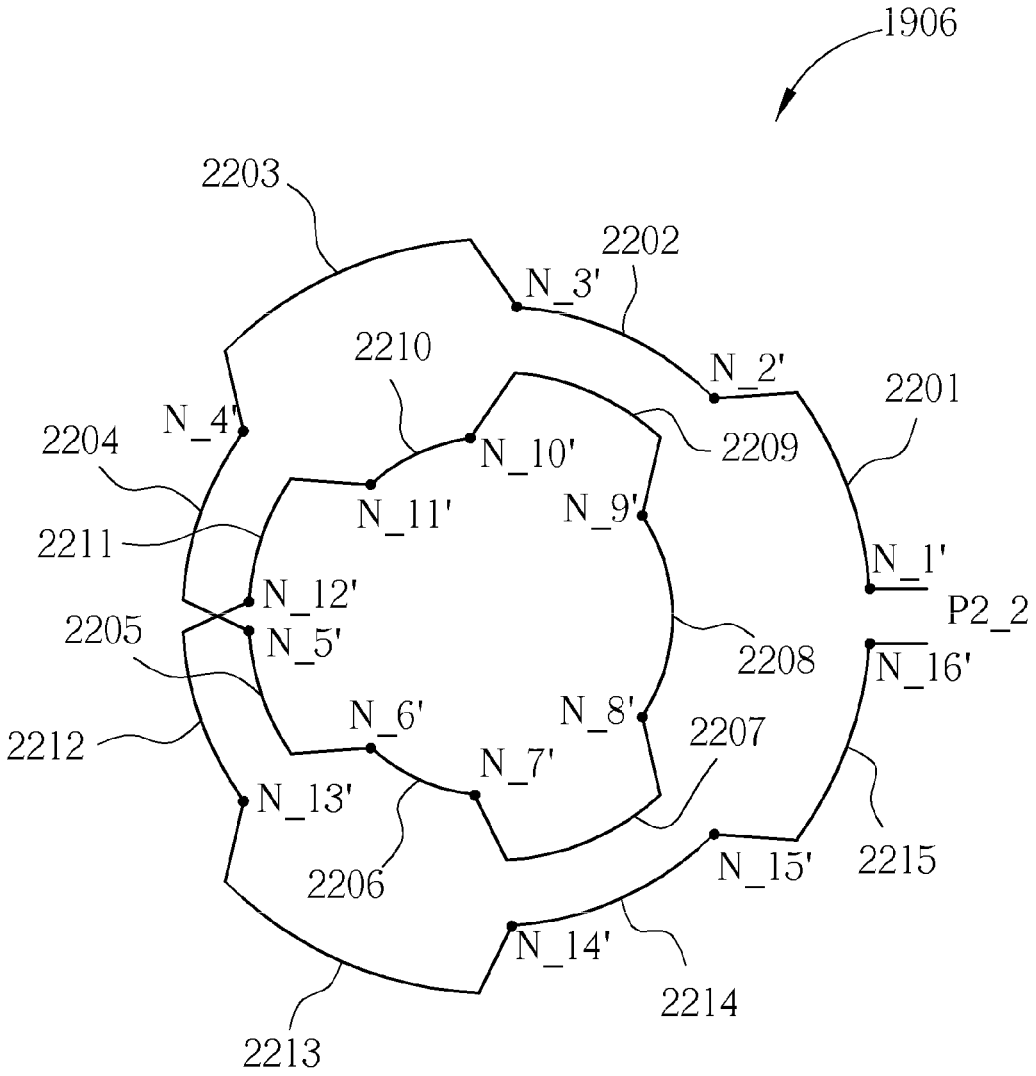
FIG. 22 is a diagram illustrating a layout pattern of the other second winding conductor shown in FIG. 20.

The exemplary transformer-based circuit 1900 can be a 1-to-2 transformer power splitter, where node N1 acts as a center-tap node of the primary winding conductor; in addition, the exemplary transformer-based circuit 1900 can also be a 2-to-1 transformer power combiner, where nodes N2, N3 act as center-tap nodes of the respective primary winding conductors. The transformer-based circuit 1900 includes a first winding conductor 1902 and two second winding conductors 1904, 1906. For clarity, the overall layout pattern of the first winding conductor 1902 is shown in FIG. 20, and the overall layout patterns of the second winding conductors 1904, 1906 are shown in FIG. 21 and FIG. 22, respectively. As shown in FIG. 20, the first winding conductor 1902 includes a plurality of sectors 2002, 2004, 2006, 2008, 2010, 2012, 2014 connected in series to thereby form a plurality of loops 2022, 2024, 2026, 2028, where the loops 2022, 2024, 2026, 2028 are arranged in a concentric-like shape. Besides, the loop 2022 is the outer-most loop, and the loop 2028 is the inner-most loop. In this exemplary embodiment, the loops 2022, 2024, 2026, 2028 of the first winding conductor 1902 from the outer-most loop (inner-most loop) to the inner-most loop (outer-most loop) are divided into a plurality of loop groups 2030, 2040 each having one or more loops. Please refer to FIG. 19 in conjunction with FIG. 20-FIG. 22. In this case, the leading sector and the last sector (2101 and 2115, or 2201 and 2215) connected to the corresponding second port (P2_1 or P2_2) are both magnetically coupled to an outer-most loop of the first winding conductor 1902. The second winding conductor 1904, 1906 is successively and magnetically coupled to the loop groups 2030, 2040 from an outer-most loop group (e.g., 2030) to an inner-most loop group (e.g., 2040) in an inward direction and then from the inner-most loop group to the outer-most loop group in an outward direction; in addition, for any loop group 2030, 2040 having a plurality of specific loops included therein, the second winding conductor 1904, 1906 includes one or more sector groups each having at least K (K=4 in this exemplary embodiment) successive sectors, and the K successive sectors are respectively and magnetically coupled to the specific loops according to an alternating sequence of a first order of the specific loops and a second order of the specific loops, where the total number of the specific loops is smaller than the positive integer K, and the first order is an inverse of the second order. More specifically, successive sectors 2101, 2102, 2103, 2104 of one sector group are respectively and magnetically coupled to the loops 2022 and 2024 of the loop group 2030 according to an alternating sequence of one order of loops 2022 and 2024 (e.g., 2022 to 2024) and the other order of loops 2022 and 2024 (e.g., 2024 to 2022); successive sectors 2105, 2106, 2107, 2108, 2109, 2110, 2111 of another sector group are respectively and magnetically coupled to the loops 2028 and 2026 of the loop group 2040 according to an alternating sequence of one order of loops 2026 and 2028 (e.g., 2026 to 2028) and the other order of loops 2026 and 2028 (e.g., 2028 to 2026); and the successive sectors 2112, 2113, 2114, 2115 of yet another sector group are respectively and magnetically coupled to the loops 2024 and 2022 of the loop group 2030 according to an alternating sequence of one order of loops 2022 and 2024 (e.g., 2024 to 2022) and the other order of loops 2022 and 2024 (e.g., 2022 to 2024). As clearly shown in FIG. 21, the sectors 2101-2115 are separated by, for example, nodes N_1-N_16; however, such segmentation applied to the second winding conductor 1904 merely serves one possible implementation, and should not be treated as a limitation to the scope of the present invention. Provided that the size of the winding conductor crossing part is small and negligible, each of the sectors 2101-2107, 2109-2115 propagates along a corresponding magnetically coupled loop of the first winding conductor 1902 to thereby have a propagation path substantially corresponding to a single unit circular angle, while the sector 2108 propagates along an inner-most loop (e.g., 2028) of the first winding conductor 1902 to thereby have a propagation path substantially corresponding to multiple unit circular angles (e.g., two unit circular angles).

Similarly, regarding the second winding conductor 1906, successive sectors 2201, 2202, 2203, 2204 of one sector group are respectively and magnetically coupled to the loops 2022, 2024 of the loop group 2030 according to an alternating sequence of one order of loops 2022 and 2024 (e.g., 2022 to 2024) and the other order of loops 2022 and 2024 (e.g., 2024 to 2022); successive sectors 2205, 2206, 2207, 2208, 2209, 2210, 2211 of another sector group are respectively and magnetically coupled to the loops 2026, 2028 of the loop group 2040 according to an alternating sequence of one order of loops 2026 and 2028 (e.g., 2026 to 2028) and the other order of loops 2026 and 2028 (e.g., 2028 to 2026); and successive sectors 2212, 2213, 2214, 2215 of yet another sector group are respectively and magnetically coupled to the loops 2024, 2022 of the loop group 2030 according to an alternating sequence of one order of loops 2022 and 2024 (e.g., 2024 to 2022) and the other order of loops 2022 and 2024 (e.g., 2024 to 2022). As clearly shown in FIG. 22, the sectors 2201-2215 are separated by, for example, nodes N_1'-N_16'; however, such segmentation applied to the second winding conductor 1906 merely serves one possible implementation, and should not be treated as a limitation to the scope of the present invention. Provided that the size of the winding conductor crossing part is small and negligible, each of the sectors 2201-2207, 2209-2215 propagates along a corresponding magnetically coupled loop of the first winding conductor 1902 to thereby have a propagation path substantially corresponding to a single unit circular angle, while the sector 2208 propagates along an inner-most loop (e.g., 2028) of the first winding conductor 1902 to thereby have a propagation path substantially corresponding to multiple unit circular angles (e.g., two unit circular angles).

In another case where the leading sector and the last sector connected to the corresponding second port are both magnetically coupled to an inner-most loop of the first winding conductor 1902 (e.g., the first winding conductor 1902 is modified according to teachings of the exemplary design shown in FIG. 5), the second winding conductor 1904, 1906 is successively and magnetically coupled to the loop groups 2028, 2026 from an inner-most loop group (e.g., 2040) to an outer-most loop group (e.g., 2030) in an outward direction and then from the outer-most loop group to the inner-most loop group in an inward direction; besides, for any loop group 2030, 2040 having a plurality of specific loops included therein, the second winding conductor includes one or more sector groups each having at least K successive sectors, where the specific loops are magnetically coupled to the K successive sectors in an alternate order. As a person skilled in the art can readily understand such an alternative design after reading above paragraphs directed to the exemplary embodiment shown in FIG. 19, further description is omitted here for brevity.

As mentioned above, the parameters M, N, and K decides the finalized layout patterns of the second winding conductors included in a transformer-based circuit. In accordance with the design rule mentioned above, FIG. 23 and FIG. 24 therefore show other exemplary embodiments of a transformer-based circuit according to the present invention, respectively. Specifically, the exemplary transformer-based circuit 2300 in FIG. 23 with the parameter settings M=3, N=3, and K=4 has one first port P1 and three second ports P2_1, P2_2, P2_3, where a unit circular angle thereof is equal to 30°

$$\left(\frac{360^\circ}{4\cdot 3} = 30^\circ\right).$$

The exemplary transformer-based circuit 2300 can be a 1-to-3 transformer power splitter, where node N1 acts as a center-tap node of the primary winding conductor; in addition, the exemplary transformer-based circuit 2300 can also be a 3-to-1 transformer power combiner, where nodes N2, N3, N4 act as center-tap nodes of the respective primary winding conductors.

Figure 24:
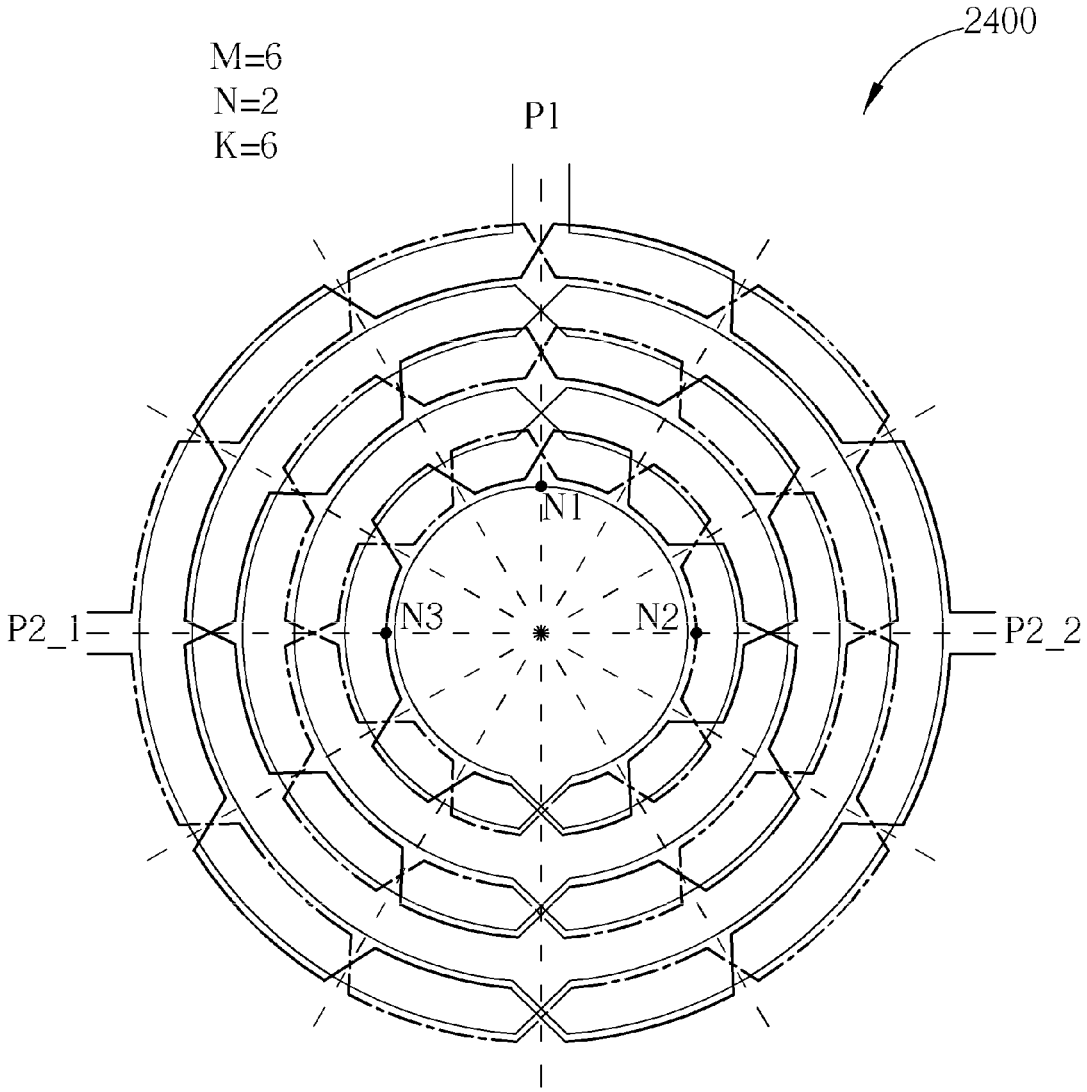
FIG. 24 is a diagram illustrating an exemplary transformer-based circuit according to the present invention.

The exemplary transformer-based circuit 2400 in FIG. 24 with the parameter settings M=6, N=2, and K=6 has one first port P1 and two second ports P2_1, P2_2, where a unit circular angle thereof is equal to 30°

$$\left(\frac{360^\circ}{6\cdot 2} = 30^\circ\right).$$

The exemplary transformer-based circuit 2400 can be a 1-to-2 transformer power splitter, where node N1 acts as a center-tap node of the primary winding conductor; in addition, the exemplary transformer-based circuit 2400 can also be a 2-to-1 transformer power combiner, where nodes N2, N3 act as center-tap nodes of the respective primary winding conductors.

Figure 19:
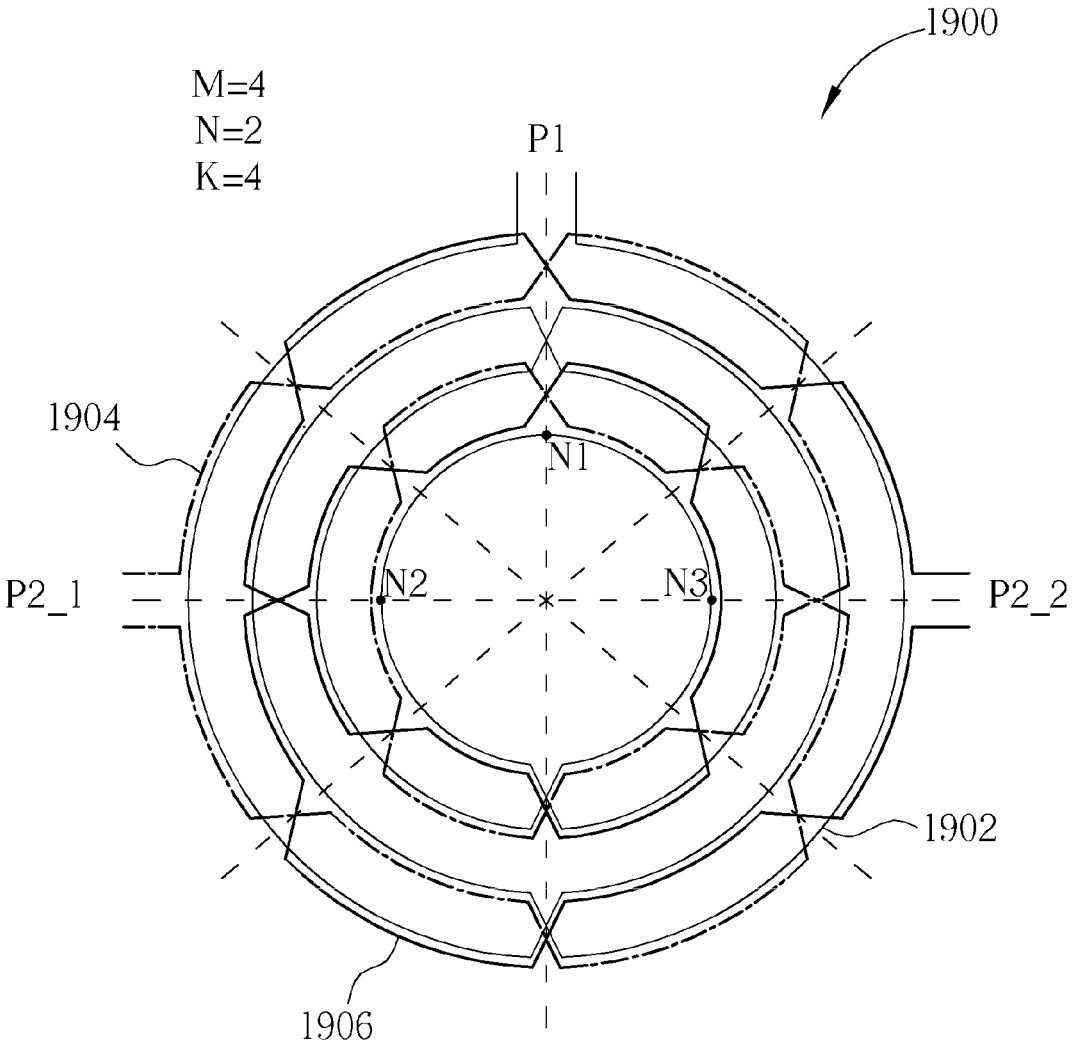
FIG. 19 is a diagram illustrating an exemplary transformer-based circuit according to the present invention.
Figure 23:
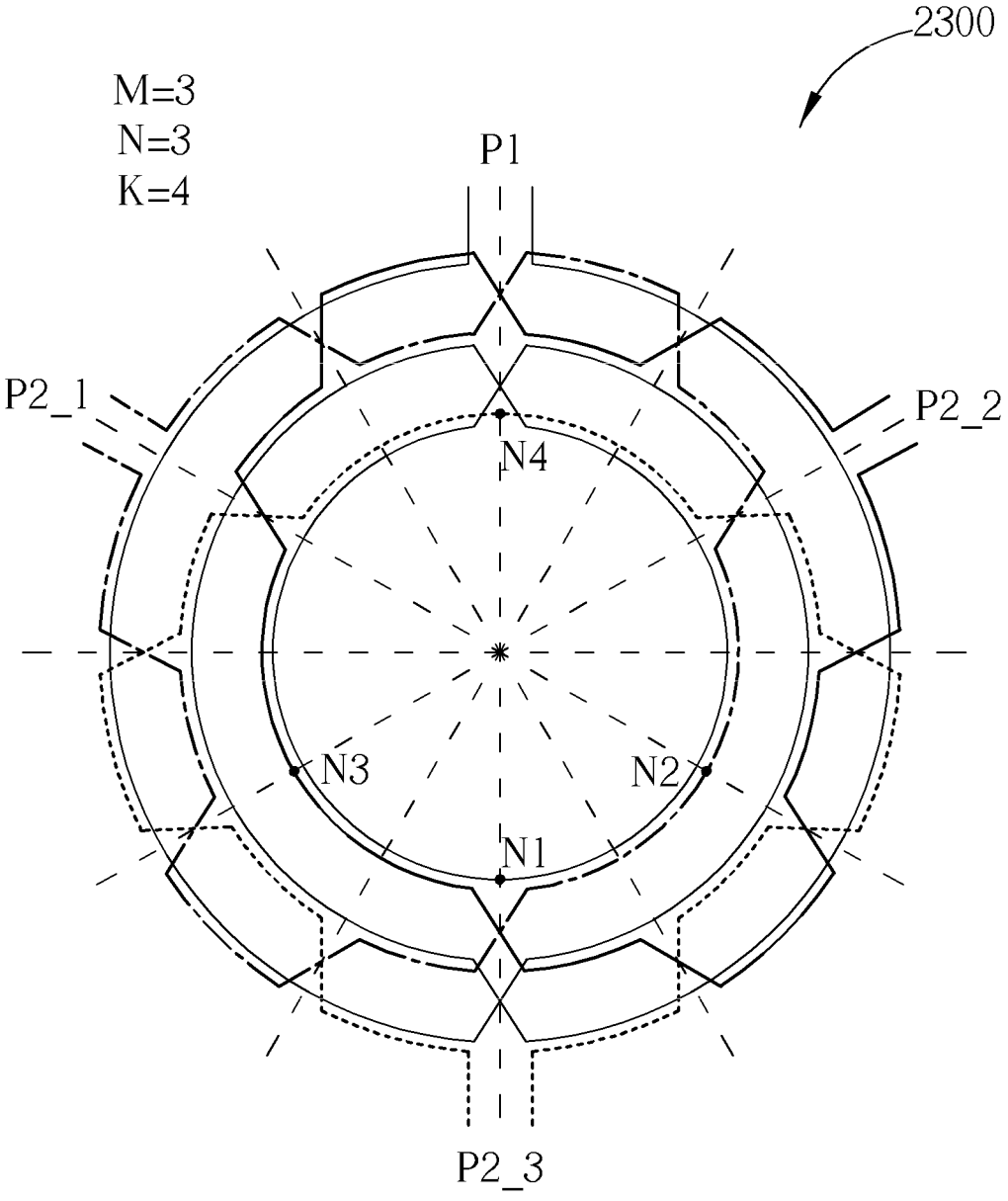
FIG. 23 is a diagram illustrating an exemplary transformer-based circuit according to the present invention.

Please note that modifications made to the exemplary embodiments shown in FIG. 19, FIG. 23, FIG. 24 without departing from the spirit of the present invention are feasible. For instance, the first winding conductor can be modified according to teachings of the exemplary design shown in FIG. 5, and/or each second winding conductor can be modified according to teachings of the exemplary design shown in FIG. 6/FIG. 7.

Briefly summarized, another design rule for configuring the overall layout pattern of each second winding conductor is summarized as follows: (a) starting from one terminal of a second port of a second winding conductor at an outer-most (inner-most) loop of a first winding conductor in a clockwise or counterclockwise direction; (b) moving for successive K unit circular angles, wherein during the moving for successive K unit circular angles, make a jump to and fro between an inner (outer) loop and an outer (inner) loop adjacent to the inner (outer) loop; (c) making a jump to an inner (outer) loop of the first winding conductor; (d) continuing inward (outward) loop jumps for the moving of every K unit circular angles; (e) at the inner-most (outer-most) loop of the first winding conductor, making proper propagation, if needed, by one or more unit circular angles to make symmetry; (f) continuing loop jumps outward (inward) for the moving of every K unit circular angles in the same way; and (g) ending up at the other terminal of the second port of the second winding conductor at the outer-most (inner-most) loop of the first winding conductor.

A transformer power combiner/splitter can also be realized using multiple exemplary transformer-based circuits of the present invention. For example, a plurality of transformer-based circuits each having the same layout design can be combined together to build one desired transformer power combiner/splitter. Please refer to FIG. 25, which shows an exemplary transformer-based circuit built by two transformer-based circuits according to the present invention. In this exemplary embodiment, the transformer-based circuit 2500 is built by two transformer-based circuits 2502, 2504, where the transformer-based circuits 2502, 2504 have the same layout design. More specifically, the transformer-based circuit 2502 has a first winding conductor 2512 electrically connected to a first port P1, and a plurality of second winding conductors 2514, 2516 magnetically coupled to the first winding conductor 2512 and further electrically connected to the second ports P2_1, P2_2, respectively; besides, the transformer-based circuit 2504 has a first winding conductor 2522 electrically connected to the first port P1 mentioned above, and a plurality of second winding conductors 2524, 2526 magnetically coupled to the first winding conductor 2522 and further electrically connected to the second ports P2_3, P2_4, respectively.

In a case where the transformer-based circuit 2500 is configured as a transformer power splitter, each of the first winding conductors 2512, 2522 acts as a primary winding conductor, and each of the second winding conductors 2514, 2516, 2524, 2526 acts as a secondary winding conductor. Based on the configuration shown in FIG. 25, a 1-to-4 transformer power splitter is therefore built by two 1-to-2 transformer power splitters. In another case where the transformer-based circuit 2500 is configured as a transformer power combiner, each of the first winding conductors 2512, 2522 acts as a secondary winding conductor, and each of the second winding conductors 2514, 2516, 2524, 2526 acts as a primary winding conductor. Based on the configuration shown in FIG. 25, a 4-to-1 transformer power combiner is therefore built by two 2-to-1 transformer power combiners.

Figure 25:
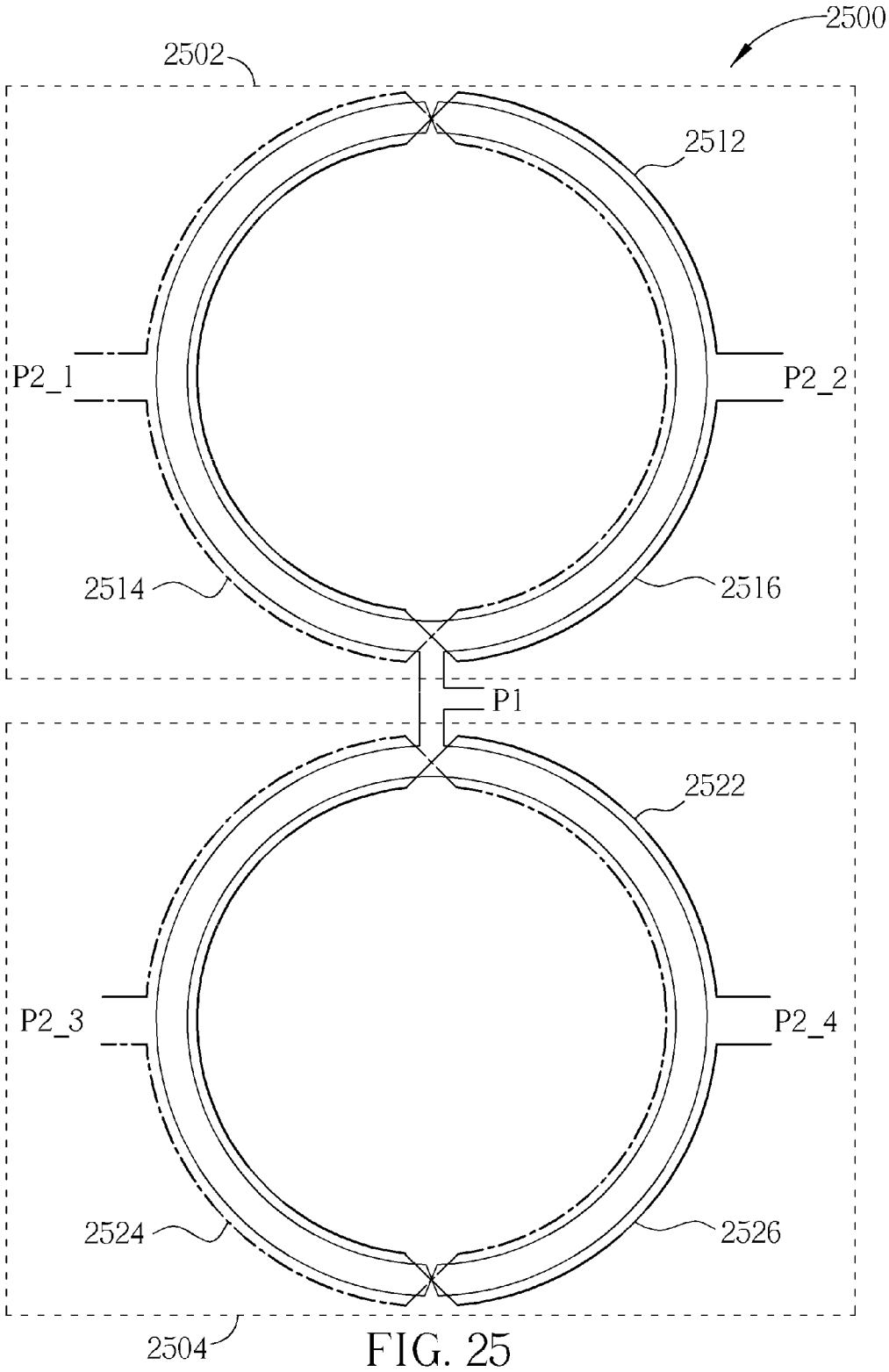
FIG. 25 is a diagram illustrating an exemplary transformer-based circuit built by two transformer-based circuits according to the present invention.

It should be noted that the layout designs of the winding conductors as shown in FIG. 25 are for illustrative purposes only. Based on the actual design requirements, the transformer-based circuits 2502, 2504 can be implemented using any transformer-based circuits obeying the spirit of the present invention. By way of example, but not limitation, an overall layout pattern of the combination of transformer-based circuits 2502 and 2504 is preferably symmetrical. Furthermore, the interconnection of the transformer-based circuits 2502 and 2504 (i.e., the layout design around the first port P1) as shown in FIG. 5 may be properly modified as long as the symmetry requirement is still satisfied.

In conclusion, a transformer-based circuit with a compact and/or symmetrical layout design can be realized according to teachings of the exemplary embodiments of the present invention. For example, each of the loops of the first winding conductor is magnetically coupled by all of the second winding conductors such that the second winding conductors and the loops of the first winding conductor are fully twisted together, overall layout patterns of the second winding conductors are substantially identical to each other, and/or each of the first and second winding conductors has a symmetrical layout pattern.

Those skilled in the art will readily observe that numerous modifications and alterations of the device and method may be made while retaining the teachings of the invention.

What is claimed is:

1. A transformer-based circuit, having at least a first port and a plurality of second ports, the transformer-based circuit comprising:

a first winding conductor, electrically connected to the first port, the first winding conductor having a plurality of sectors connected in series to thereby form a plurality of loops, wherein the loops are arranged in a concentric-like fashion; and a plurality of second winding conductors, magnetically coupled to the first winding conductor, wherein the second winding conductors are electrically connected to the second ports, respectively, each of the second winding conductors is routed on a plurality of metal layers, and includes a plurality of layout patterns on the metal layers, respectively, where regarding each of the metal layers, layout patterns of the second winding conductors on a same metal layer are identical to each other;

wherein the first winding conductor acts as one of a primary winding conductor and a secondary winding conductor, and each of the second winding conductors acts as the other of the primary winding conductor and the secondary winding conductor.

2. The transformer-based circuit of claim 1, wherein the first winding conductor has a symmetrical layout around the first port, and each of the second winding conductors has a symmetrical layout around the corresponding second port.

3. The transformer-based circuit of claim 2, being a transformer power splitter, wherein the first winding conductor acts as the primary winding conductor, and further has a symmetrical layout around a center-tap node thereof.

4. The transformer-based circuit structure of claim 3, wherein an overall layout pattern of the first winding conductor is symmetrical, and an overall layout pattern of each of the second winding conductors is symmetrical.

5. The transformer-based circuit of claim 3, wherein the first port is connected to one of an outer-most loop and an inner-most loop of the loops, and the center-tap node is at the other of the outer-most loop and the inner-most loop of the loops.

6. The transformer-based circuit of claim 5, wherein each of the second winding conductors has a plurality of sectors connected in series; the sectors of the second winding conductor include a leading sector starting from a first terminal of the corresponding second port to which the second winding conductor electrically connected and a last sector ending up at a second terminal of the corresponding second port; and the leading sector and the last sector are both magnetically coupled to either the inner-most loop of the loops or the outer-most loop of the loops.

7. The transformer-based circuit of claim 2, being a transformer power combiner, wherein each of the second winding conductors acts as one primary winding conductor, and further has a symmetrical layout around a center-tap node thereof.

8. The transformer-based circuit structure of claim 7, wherein an overall layout pattern of the first winding conductor is symmetrical, and an overall layout pattern of each of the second winding conductors is symmetrical.

9. The transformer-based circuit of claim 7, wherein the first port is connected to either an inner-most loop of the loops or an outer-most loop of the loops.

10. The transformer-based circuit of claim 9, wherein each of the second winding conductors has a plurality of sectors connected in series; the sectors of the second winding conductor include a leading sector starting from a first terminal of the corresponding second port to which the second winding conductor electrically connected, a last sector ending up at a second terminal of the corresponding second port, and a specific sector where a corresponding center-tap node is located; the leading sector and the last sector are both magnetically coupled to one of the inner-most loop and the outer-most loop of the loops; and the specific sector is magnetically coupled to the other of the inner-most loop and the outer-most loop of the loops.

11. The transformer-based circuit of claim 1, wherein the first winding conductor comprises a specific metal strip; each of the second winding conductors comprises a first metal strip, a second metal strip, and a third metal strip; the specific metal strip, the first metal strip, and the second metal strip are coplanar, where the first metal strip and the second metal strip are adjacent to a first side and a second side of the specific metal strip, respectively; and the third metal strip is adjacent to a third side of the specific metal strip.

12. The transformer-based circuit of claim 1, wherein each of the loops is magnetically coupled by all of the second winding conductors such that the second winding conductors and the loops of the first winding conductor are fully twisted together.

13. The transformer-based circuit of claim 12, wherein at least one of the loops is fully coupled by all of the second winding conductors.

14. The transformer-based circuit of claim 13, wherein the at least one of the loops is evenly coupled by the second winding conductors, substantially.

15. The transformer-based circuit of claim 1, wherein a number of the loops of the first winding conductor is equal to M, and a number of the second winding conductors is equal to N, where $$\frac{M}{N}$$

is an integer.

16. The transformer-based circuit of claim 15, wherein a unit circular angle with respect to a specific point is equal to $$\frac{360°}{K \cdot N},$$

where K is an even number; each of the second winding conductors has a plurality of sectors connected in series, where the sectors of the second winding conductor include a leading sector starting from a first terminal of the corresponding second port to which the second winding conductor electrically connected and a last sector ending up at a second terminal of the corresponding second port; every two successively connected sectors of the second winding conductor are magnetically coupled to different loops of the first winding conductor; and each of the sectors of the second winding conductor propagates along a corresponding magnetically coupled loop to thereby have a propagation path substantially corresponding to an integral multiple of the unit circular angle with respect to the specific point.

17. The transformer-based circuit of claim 16, wherein the leading sector and the last sector are both magnetically coupled to an outer-most loop of the loops, and the sectors of the second winding conductor include first sectors each propagating along a corresponding magnetically coupled loop to thereby have a propagation path substantially corresponding to a single unit circular angle and only one second sector propagating along an inner-most loop of the loops to thereby have a propagation path substantially corresponding to multiple unit circular angles, where the first sectors comprise at least the leading sector and the last sector.

18. The transformer-based circuit of claim 17, wherein the sectors of the second winding conductor are successively and magnetically coupled to the loops from the outer-most loop to the inner-most loop in an inward direction and then from the inner-most loop to the outer-most loop in an outward direction.

19. The transformer-based circuit of claim 17, wherein $K \cdot N \geq M$; the loops of the first winding conductor from the outer-most loop to the inner-most loop are divided into a plurality of loop groups each having one or more loops; the second winding conductor is successively and magnetically coupled to the loop groups from an outer-most loop group to an inner-most loop group in an inward direction and then from the inner-most loop group to the outer-most loop group in an outward direction; and for any loop group having a plurality of specific loops included therein, the second winding conductor includes one or more sector groups each having at least K successive sectors included in the sectors of the second winding conductor, and the K successive sectors are respectively and magnetically coupled to the specific loops according to an alternating sequence of a first order of the specific loops and a second order of the specific loops, where a number of the specific loops is smaller than K, and the first order is an inverse of the second order.

20. The transformer-based circuit of claim 16, wherein the leading sector and the last sector are both magnetically coupled to an outer-most loop of the loops, and the sectors of the second winding conductor include first sectors each propagating along a corresponding magnetically coupled loop to thereby have a propagation path substantially corresponding to a single unit circular angle, second sectors each propagating along an inner-most loop of the loops to thereby have a propagation path substantially corresponding to multiple unit circular angles, and at least a third sector propagating along the outer-most loop of the loops to thereby have a propagation path substantially corresponding to multiple unit circular angles, where the first sectors comprise at least the leading sector and the last sector.

21. The transformer-based circuit of claim 20, wherein the sectors of the second winding conductor are successively and magnetically coupled to the loops from the outer-most loop to the inner-most loop in an inward direction and then from the inner-most loop to the outer-most loop in an outward direction, repeatedly.

22. The transformer-based circuit of claim 16, wherein the leading sector and the last sector are both magnetically coupled to an inner-most loop of the loops, and the sectors of the second winding conductor include first sectors each propagating along a corresponding magnetically coupled loop to thereby have a propagation path substantially corresponding to a single unit circular angle and only one second sector propagating along an outer-most loop of the loops to thereby have a propagation path substantially corresponding to multiple unit circular angles, where the first sectors comprise at least the leading sector and the last sector.

23. The transformer-based circuit of claim 22, wherein the sectors of the second winding conductor are successively and magnetically coupled to the loops from the inner-most loop to the outer-most loop in an outward direction and then from the outer-most loop to the inner-most loop in an inward direction.

24. The transformer-based circuit of claim 22, wherein $K \cdot N \geq M$; the loops of the first winding conductor from the inner-most loop to the outer-most loop are divided into a plurality of loop groups each having one or more loops; the second winding conductor is successively and magnetically coupled to the loop groups from an inner-most loop group to an outer-most loop group in an outward direction and then from the outer-most loop group to the inner-most loop group in an inward direction; and for any loop group having a plurality of specific loops included therein, the second winding conductor includes one or more sector groups each having at least K successive sectors included in the sectors of the second winding conductor, and the K successive sectors are respectively and magnetically coupled to the specific loops according to an alternating sequence of a first order of the specific loops and a second order of the specific loops, where a number of the specific loops is smaller than K, and the first order is an inverse of the second order.

25. The transformer-based circuit of claim 16, wherein the leading sector and the last sector are both magnetically coupled to an inner-most loop of the loops, and the sectors of the second winding conductor include first sectors each propagating along a corresponding magnetically coupled loop to thereby have a propagation path substantially corresponding to a single unit circular angle, second sectors propagating along an outer-most loop of the loops to thereby have a propagation path substantially corresponding to multiple unit circular angles, and at least a third sector propagating along the inner-most loop of the loops to thereby have a propagation path substantially corresponding to multiple unit circular angles, where the first sectors comprise at least the leading sector and the last sector.

26. The transformer-based circuit of claim 25, wherein the sectors of the second winding conductor are successively and magnetically coupled to the loops from the inner-most loop to the outer-most loop in an outward direction and then from the outer-most loop to the inner-most loop in an inward direction, repeatedly.

27. The transformer-based circuit of claim 1, further having a plurality of third ports and further comprising:

a third winding conductor, electrically connected to the first port, the third winding conductor having a plurality of sectors connected in series to thereby form a plurality of loops; and a plurality of fourth winding conductors, magnetically coupled to the third winding conductor, the fourth winding conductors being electrically connected to the third ports, respectively, overall layout patterns of the fourth winding conductors being identical to each other;

wherein each of the first winding conductor and the third winding conductor acts as one of the primary winding conductor and the secondary winding conductor, and each of the second winding conductors and the fourth winding conductors acts as the other of the primary winding conductor and the secondary winding conductor.

28. A transformer-based circuit, having a first port and a plurality of second ports, the transformer-based circuit comprising:

a first winding conductor, electrically connected to the first port, the first winding conductor having a plurality of sectors connected in series to thereby form a plurality of loops, wherein an overall layout pattern of the first winding conductor is symmetrical, and the loops are arranged in a concentric-like fashion; and a plurality of second winding conductors, magnetically coupled to the first winding conductor, the second winding conductors being electrically connected to the second ports, respectively, wherein each of the second winding conductors is routed on a plurality of metal layers, and includes a plurality of layout patterns on the metal layers, respectively, where each of the layout patterns on the metal layers is symmetrical;

wherein the first winding conductor acts as one of a primary winding conductor and a secondary winding conductor, and each of the second winding conductors acts as the other of the primary winding conductor and the secondary winding conductor.

* * * * *